US009022757B2

(12) United States Patent
Shin et al.

(10) Patent No.: US 9,022,757 B2
(45) **Date of Patent: *May 5, 2015**

(54) COMPRESSOR

(75) Inventors: Jinung Shin, Seoul (KR); Seseok Seol, Seoul (KR)

(73) Assignee: LG Electronics Inc., Seoul (KR)

( * ) Notice: Subject to any disclaimer, the term of this patent is extended or adjusted under 35 U.S.C. 154(b) by 50 days.

This patent is subject to a terminal disclaimer.

(21) Appl. No.: 13/338,778

(22) Filed: Dec. 28, 2011

(65) Prior Publication Data

US 2012/0171060 A1 Jul. 5, 2012

(30) Foreign Application Priority Data

Dec. 29, 2010 (KR) ..... 10-2010-0138169

(51) Int. Cl.

| | |
|---|---|
| ***F01C 1/02*** | (2006.01) |
| ***F01C 1/063*** | (2006.01) |
| ***F03C 2/00*** | (2006.01) |
| ***F03C 4/00*** | (2006.01) |
| ***F04C 2/00*** | (2006.01) |

(Continued)

(52) U.S. Cl.

CPC ..... *F04C 23/008* (2013.01); *F04C 18/322* (2013.01); *F04C 29/025* (2013.01); *F04C 29/06* (2013.01); *F04C 2240/40* (2013.01); *F04C 2240/804* (2013.01); *F04C 2270/12* (2013.01); *F04C 29/0035* (2013.01)

(58) Field of Classification Search

USPC ..... 418/63, 66, 91–94, 102–103, 228–229, 418/183, 173–177, 270, DIG. 1; 417/356–357, 410.1, 902

See application file for complete search history.

(56) References Cited

U.S. PATENT DOCUMENTS

| | | | | |
|---|---|---|---|---|
| 2,122,462 | A | 7/1938 | Fricke | 230/140 |
| 2,415,011 | A * | 1/1947 | Hubacker | 417/256 |

(Continued)

FOREIGN PATENT DOCUMENTS

| | | |
|---|---|---|
| CN | 1069107 | 2/1993 |
| CN | 1140806 | 1/1997 |

(Continued)

OTHER PUBLICATIONS

International Search Report and Written Opinion dated May 1, 2012. (PCT/KR2011/010111).

(Continued)

*Primary Examiner* — Kenneth Bomberg
*Assistant Examiner* — Deming Wan
(74) *Attorney, Agent, or Firm* — KED & Associates, LLP

(57) ABSTRACT

A compressor is provided that includes an accumulator formed in an internal space of a shell to reduce a size of the compressor. An accumulator space may be formed using the shell of the compressor, thereby simplifying an assembly process. A stationary shaft having a refrigerant suction passage may be directly connected to the accumulator to prevent leakage of refrigerant. A discharge passage may be formed in a rotating body to enhance a cooling effect of a drive motor, and an oil separating member may be installed in the discharge passage to prevent oil from being excessively leaked out. A center of gravity of the accumulator may correspond to a center of gravity of the compressor to reduce vibration noise of the compressor caused by the accumulator. An area for installing a compressor including the accumulator may be minimized to enhance design flexibility of an outdoor device.

19 Claims, 18 Drawing Sheets

(51) Int. Cl.

| | |
|---|---|
| ***F04C 18/00*** | (2006.01) |
| ***F01C 21/00*** | (2006.01) |
| ***F04C 15/00*** | (2006.01) |
| ***F04C 29/00*** | (2006.01) |
| ***F04C 23/00*** | (2006.01) |
| ***F04C 18/32*** | (2006.01) |
| *F04C 29/02* | (2006.01) |
| *F04C 29/06* | (2006.01) |

(56) References Cited

U.S. PATENT DOCUMENTS

| | | | | |
|---|---|---|---|---|
| 2,420,124 | A | 5/1947 | Coulson | |
| 2,440,593 | A * | 4/1948 | Miller | 418/88 |
| 3,153,334 | A | 10/1964 | Vutz | |
| 4,624,630 | A | 11/1986 | Hirahara et al. | |
| 4,826,408 | A * | 5/1989 | Inoue et al. | 418/60 |
| 5,261,800 | A * | 11/1993 | Sakae | 418/63 |
| 5,295,788 | A | 3/1994 | Tajima et al. | |
| 5,374,171 | A * | 12/1994 | Cooksey | 418/63 |
| 5,542,831 | A * | 8/1996 | Scarfone | 418/60 |
| 6,213,732 | B1 | 4/2001 | Fujio | |
| 6,592,346 | B2 * | 7/2003 | Bushnell | 418/63 |
| 6,817,490 | B2 | 11/2004 | Petit | |
| 6,824,367 | B2 | 11/2004 | Matsumoto et al. | |
| 7,344,367 | B2 | 3/2008 | Manole | |
| 7,361,004 | B2 * | 4/2008 | Hwang et al. | 418/59 |
| 7,607,904 | B2 * | 10/2009 | Masuda | 418/62 |
| 2003/0072664 | A1 | 4/2003 | Bushnell | 418/63 |
| 2005/0031465 | A1 | 2/2005 | Dreiman et al. | |
| 2005/0201884 | A1 | 9/2005 | Dreiman | |
| 2006/0127256 | A1 | 6/2006 | Hwang et al. | 418/29 |
| 2006/0159570 | A1 | 7/2006 | Manole | 471/440 |
| 2009/0155111 | A1 * | 6/2009 | Okaichi et al. | 418/29 |
| 2010/0092322 | A1 | 4/2010 | Furusho et al. | |
| 2010/0322796 | A1 | 12/2010 | Ko | |

FOREIGN PATENT DOCUMENTS

| | | | |
|---|---|---|---|
| CN | 1763376 | | 4/2006 |
| CN | 1957181 | | 5/2007 |
| CN | 101135309 | | 3/2008 |
| EP | 0 526 145 | A2 | 2/1993 |
| EP | 1 657 444 | A1 | 5/2006 |
| JP | 61-187591 | | 8/1986 |
| JP | 62-284985 | | 12/1987 |
| JP | 63-186988 | | 8/1988 |
| JP | 2000-283074 | | 10/2000 |
| JP | 2002-221156 | | 8/2002 |
| KR | 10-1998-043393 | | 9/1998 |
| KR | 10-1999-0012573 | | 2/1999 |
| KR | 10-0240202 | | 2/1999 |
| KR | 10-0230999 | B1 | 11/1999 |
| KR | 10-1999-0084586 | | 12/1999 |
| KR | 10-2000-0033611 | | 6/2000 |
| KR | 20-2001-0002267 | | 10/2001 |
| KR | 10-2010-0010441 | | 2/2010 |
| WO | WO 2010/010994 | A2 | 1/2010 |
| WO | WO 2010/010996 | | 1/2010 |

OTHER PUBLICATIONS

International Search Report and Written Opinion dated May 1, 2012. (PCT/KR2011/010108).
International Search Report and Written Opinion dated May 1, 2012. (PCT/KR2011/010110).
International Search Report and Written Opinion dated May 1, 2012. (PCT/KR2011/010166).
U.S. Office Action issued in U.S. Appl. No. 13/338,737 dated Aug. 28, 2013.
U.S. Office Action issued in U.S. Appl. No. 13/338,822 dated Sep. 9, 2013.
U.S. Office Action issued in U.S. Appl. No. 13/338,480 dated Dec. 2, 2013.
U.S. Office Action issued in U.S. Appl. No. 13/338,737 dated Dec. 31, 2013.
U.S. Office Action issued in U.S. Appl. No. 13/338,822 dated Jan. 15, 2014.
Chinese Office Action dated Feb. 7, 2014. (translation).
European Search Report dated Apr. 14, 2014. (2659142).
European Search Report dated Apr. 14, 2014. (2659144).
U.S. Office Action issued in U.S. Appl. No. 13/338,737 dated Apr. 24, 2014.
U.S. Office Action issued in U.S. Appl. No. 13/338,605 dated May 9, 20124.
U.S. Office Action issued in U.S. Appl. No. 13/338,480 dated May 13, 20124.
European Search Report issued in Application No. 11852747.2 dated Jun. 11, 2014.
Chinese Office Action dated Sep. 19, 2014, issued in Application No. 201110460468.5 (with English translation).
Notice of Allowance dated Jul. 21, 2014, issued in U.S. Appl. No. 13/338,737.
Notice of Allowance dated Aug. 6, 2014, issued in U.S. Appl. No. 13/338,822.
Notice of Allowance dated Sep. 4, 2014, issued in U.S. Appl. No. 13/338,480.
European Search Report dated Sep. 8, 2014, issued in Application No. 11853555.8.
Chinese Office Action dated Feb. 4, 2015 with English translation.

* cited by examiner

COMPRESSOR

CROSS-REFERENCE TO RELATED APPLICATION(S)

This application claims priority to Korean Application No. 10-2010-0138169, filed in Korea on Dec. 29, 2010, which is herein expressly incorporated by reference in its entirety.

BACKGROUND

1. Field

A compressor is disclosed herein.

2. Background

Compressors are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
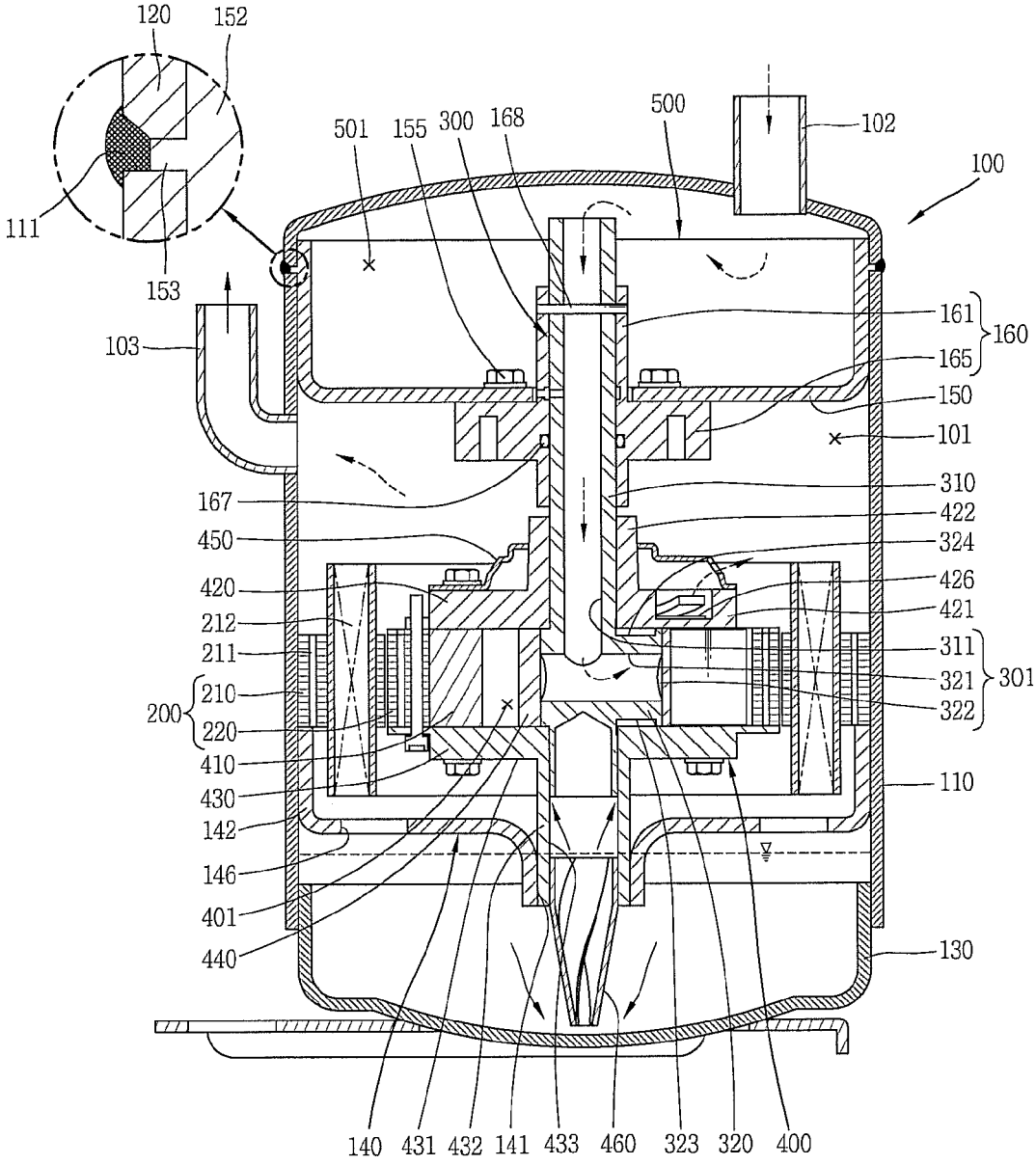
FIG. 1 is a cross-sectional view of a compressor according to an embodiment.

Hereinafter, a compressor according to embodiments will be described in detail with reference to the accompanying drawings. Where possible, like reference numerals have been used to indicate like elements.

In general, a compressor, which may be referred to as a hermetic compressor, may include a drive motor that generates a driving force installed in an internal space of a sealed shell and a compression unit or device operated by the drive motor to compress refrigerant. Compressors may be divided into reciprocating compressors, scroll compressors, rotary compressors, and oscillating compressors according to a method of compressing of a refrigerant. The reciprocating, scroll, and rotary type compressors use a rotational force of the drive motor; however, the oscillating type compressor uses a reciprocating motion of the drive motor.

In the above-described compressors, a drive motor of the compressor using a rotational force may be provided with a crank shaft that transfers a rotational force of the drive motor to the compression device. For instance, the drive motor of the rotary type compressor (hereinafter, rotary compressor) may include a stator fixed to the shell, a rotor inserted into the stator with a predetermined gap therebetween and rotated due to an interaction with the stator, and a crank shaft coupled with the rotor to transfer a rotational force of the drive motor to the compression device while being rotated together with the rotor. In addition, the compression device may include a cylinder that forms a compression space, a vane that divides the compression space of the cylinder into a suction chamber and a discharge chamber, and a plurality of bearing members that forms the compression space together with the cylinder while supporting the vane. The plurality of bearing members may be disposed at one side of the drive motor or disposed at both sides thereof, respectively, to support the drive motor in both axial and radial directions, such that the crank shaft may be rotated with respect to the cylinder.

Further, an accumulator, which may be connected to a suction port of the cylinder to divide refrigerant inhaled into the suction port into gas refrigerant and liquid refrigerant and inhale only the gas refrigerant into a compression space, may be installed at a side of the shell. The capacity of the accumulator may be determined according to a capacity of the compressor or cooling system. Further, the accumulator may be fixed by, for example, a band or a clamp at an outer portion of the shell, and may communicate with an suction port of the cylinder through an L-shaped suction pipe fixed to the shell.

However, in such a rotary compressor, the accumulator may be installed at an outer portion of the shell. Thus, a size of the compressor including the accumulator may be increased, thereby increasing a size of an electrical product employing the compressor.

Further, in such a rotary compressor, the accumulator may be connected to a separate suction pipe outside of the shell, and thus, the assembly of the shell and accumulator may be separated from each other, thereby complicating the assembly process while increasing a number of assembly processes. Moreover, a number of connecting portions may be increased, as both sides of the accumulator are connected to the shell through refrigerant pipes, respectively, thereby increasing the possibility of refrigerant leakage.

Furthermore, in such a rotary compressor, an area occupied by the compressor may be increased, because the accumulator is installed outside of the shell, thereby limiting design flexibility when the compressor is mounted, for example, on or to an outdoor device of a cooling cycle apparatus.

Also, in such a rotary compressor, the accumulator may be eccentrically disposed with respect to a center of gravity of the entire compressor including the accumulator, and thus, an eccentric load due to the accumulator may occur, as the accumulator is installed outside of the shell, thereby increasing vibration noise of the compressor.

Additionally, in such a rotary compressor, compressor vibration may be increased when increasing an eccentric load of the crank shaft when an eccentric amount of the eccentric portion is too large as the crank shaft is rotated, and in contrast, the compressor capacity may be reduced when the eccentric load of the crank shaft is small.

Further, in such a rotary compressor, a rolling piston may be rotatably coupled with an eccentric portion of the crank shaft, and a vane may be brought into contact with the rolling piston to form a compression space; however, a gap may be generated between the rolling piston and the vane when the vane is separated from the rolling piston during operation, thereby incurring compression loss of the compressor.

Furthermore, in such a rotary compressor, refrigerant discharged from the compression device may be discharged only in one direction, and thus, a flow of refrigerant in the internal space of the shell may be partially concentrated, thereby reducing a cooling efficiency of the drive motor.

Also, in such a rotary compressor, refrigerant discharged from the compression device may be mixed with oil; however, there exists no separation device for the oil, and thus, leakage of oil in the compressor may increase, thereby increasing a frictional loss due to an oil shortage in the compressor.

Additionally, in such a rotary compressor, a drive motor and a compression device installed at an inner portion of the shell may be installed at both sides of the crank shaft, thereby increasing a total height of the compressor. Due to this, the compressor cannot be installed at a center of an outdoor device, but rather, must be installed biased to one side, taking into consideration interference with other components when the compressor is mounted, for example, on an outdoor device of a cooling cycle apparatus. Therefore, a center of gravity of the outdoor device may be eccentrically located to a side where the compressor is installed, thereby causing inconvenience and spatial restrictions when moving or installing the outdoor device, as well as increasing vibration noise of the entire outdoor device.

Figure 2:
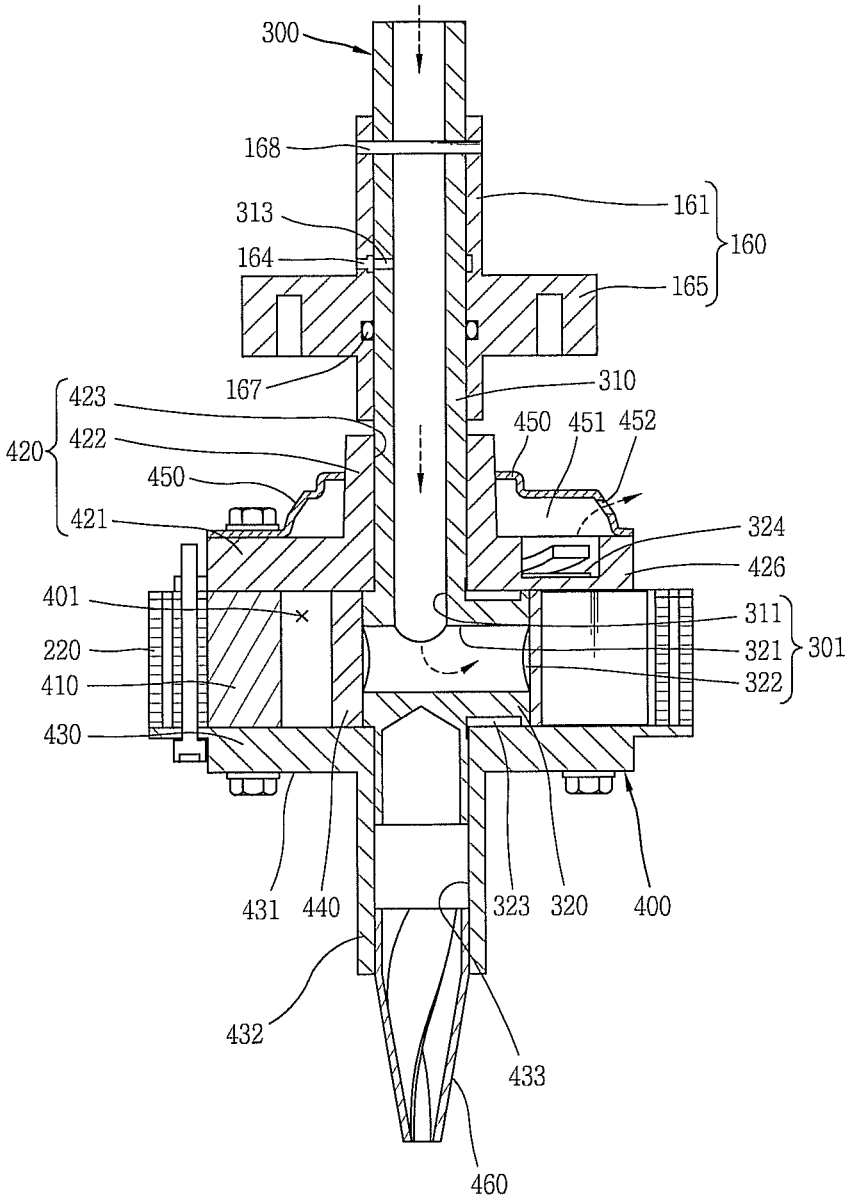
FIG. 2 is a cross-sectional view of a coupling between a stationary shaft and a compression device of the compressor of FIG. 1.
Figure 3:
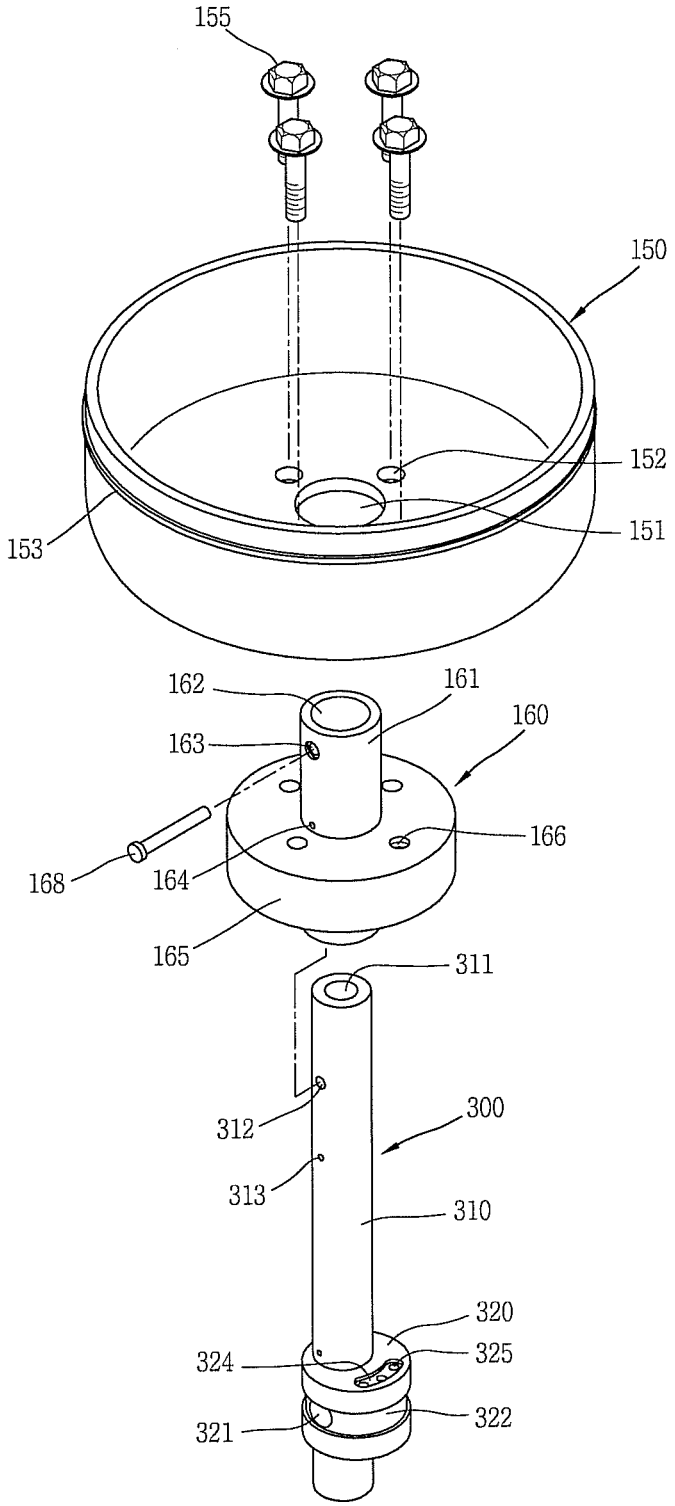
FIG. 3 is an exploded perspective view of an accumulator frame and the stationary shaft in the compressor of FIG. 1.

As illustrated in FIGS. 1 through 3, a compressor, which may be referred to as a hermetic compressor, according to this embodiment may include a drive motor 200 that generates a rotational force installed in an internal space 101 of a sealed shell 100, which may be hermetically sealed, a stationary shaft 300 fixed within the internal space 101 of the shell 100 at a center of the drive motor 200. The stationary shaft 300 may be rotatably coupled with a cylinder 410 coupled with a rotor 220 of the drive motor 200 to be rotated by the stationary shaft 300. An accumulator 500 having an accumulating chamber 501 may be provided separated within and from the internal space 101 of the shell 100.

The shell 100 may include a shell body 110, within which the drive motor 200 may be installed, an upper cap 120 that forms an upper surface of the accumulator 500 while covering an upper open end (hereinafter, "first open end") 111 of the shell body 110, and a lower cap 130 that covers a lower open end (hereinafter, "second open end") 112 of the shell body 110. The shell body 110 may be formed in, for example, a cylindrical shape. A stator 210, which will be described later, may be fixed to a middle portion of the shell body 110 in, for example, a shrink-fitting manner. Further, a lower frame 140 that supports a lower bearing 430, which will be described later, in a radial direction, as well as the stator 210 may be fixed to the shell body 110 by, for example, shrink-fitting. The lower frame 140 may include a bearing hole 141, into a center of which the lower bearing 430 may be rotatably inserted to support the stationary shaft 300, which will be described later, in a radial direction. An edge of the lower frame 140 may be bent and formed with a fixing portion 142 that allows an outer circumferential surface thereof to be closely adhered to the shell body 110. An outer front end surface of the lower frame 140, namely, an end of the fixing portion 142, may be closely adhered to a lower surface of the stator 210 and fixed to the shell body 110 to support the stator 210 in an axial direction.

Figure 4:
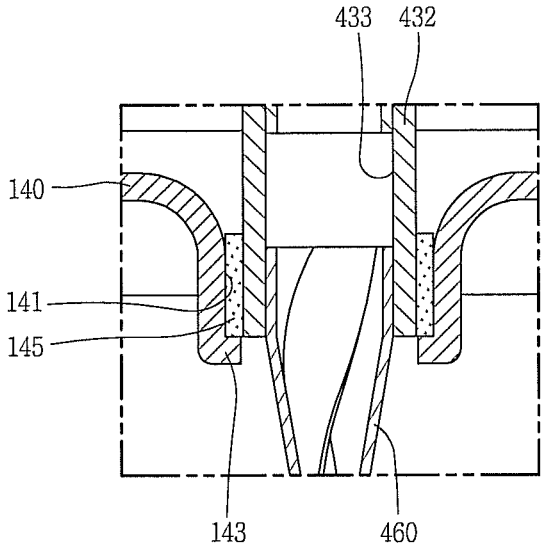
FIG. 4 is a cross-sectional view illustrating an embodiment in which a bearing member is provided between a lower frame and a lower bearing in the compressor of FIG. 1.

The lower frame 140 may be made of, for example, a metal plate or a casting. When the lower frame 140 is made of a metal plate, a separate bearing member 145, such as a ball bearing or bush, may be installed thereon, to provide lubrication between the lower frame 140 and the lower bearing 430, as illustrated in FIG. 4. However, when the lower frame 140 is made of a casting, the bearing hole 141 of the lower frame 140 may be precision processed, and therefore, a separate bearing member may not be required. When a bearing member 145 is installed between the lower frame 140 and the lower bearing 430, a bearing support portion 143 may be bent and formed to support the bearing member 145 at an end of the bearing hole 141 of the lower frame 140, as illustrated in FIG. 4.

An accumulator frame 150, which may form a lower surface of the accumulator 500, may be provided at an upper end of the shell body 110. The accumulator frame 150 may include a bush hole 151, through a center of which a stationary bush (upper bush) 160, which will be described later, may penetrate and be coupled therewith. Further, an edge of the accumulator frame 150 may include a fixing portion 153 that extends in a radial direction to overlap with the shell body 110 and an end of the upper cap 120. The fixing portion 153 of the accumulator frame 150 may be closely adhered to an inner circumferential surface of the shell body 110 and an inner circumferential surface of the upper cap 120. The fixing portion 153 may be, for example, coupled to the shell body 110 and the end of the upper cap 120 so that the body shell 110, the upper cap 120, and the accumulator frame 150 are joined together, thereby enhancing a sealability of the shell 100. The fixing protrusion 153 may be interposed between the shell body 110 and the end of the upper cap 120, as shown in FIG. 1.

The stationary bush 160 may include the shaft receiving portion 161, which may be inserted into the bush hole 151 of the accumulator frame 150, and a flange portion 165 that extends in a radial direction at a middle portion of a circumferential surface of the shaft receiving portion 161. The shaft receiving portion 161 may include a shaft receiving hole 162, through a center of which the stationary shaft 300 may penetrate. A sealing member 167 that provides a seal between the accumulating chamber 501 of the accumulator 500 and the internal space 101 of the shell 100 may be provided at the middle portion of the shaft receiving portion 161.

The flange portion 165 may be formed such that a radial directional width thereof is formed larger than a radial directional width of the shaft receiving portion 161, thereby allowing a clearance when the stationary bush 160 performs a centering operation together with the stationary shaft 300. One or more fastening hole(s) 166 may be formed at or in the flange portion 165 to correspond to one or more through hole(s) 152 of the accumulate frame 150. A diameter of the one or more fastening hole(s) 166 may be smaller than a diameter of the one or more through hole(s) 152.

An edge of the upper cap 120 may be bent to face the first open end 111 of the shell body 110, and may be, for example, welded to the first open end 111 of the shell body 110 together with the fixing portion 153 of the accumulator frame 150. Further, a suction pipe 102 that guides refrigerant to the accumulator 500 during a cooling cycle may penetrate and be coupled with the upper cap 120. The suction pipe 102 may be eccentrically disposed to one side of the upper cap 120, so as not to concentrically correspond to the refrigerant suction passage 301 of the stationary shaft 300, which will be described later, thereby preventing liquid refrigerant from being inhaled into the compression space 401. Furthermore, a discharge pipe 103 that guides refrigerant discharged into the internal space 101 of the shell 100 from the compression device 400 may penetrate and be coupled with the shell body 110 between the stator 210 and the accumulator frame 150. An edge of the lower cap 130 may be attached, for example, by welding to the second open end 112 of the shell body 110.

As illustrated in FIG. 1, the drive motor 200 may include the stator 210 fixed to the shell 100 and a rotor 220 rotatably disposed at an inner portion of the stator 210. The stator 210 may include a plurality of ring-shaped stator sheets laminated together to a predetermined height, and a coil 230 wound around a teeth portion provided at an inner circumferential surface thereof. Further, the stator 210 may be, for example, shrink-fitted to be fixed and coupled with the shell body shell 110 in an integrated manner. A front end surface of the lower frame 140 may be closely adhered and fixed to a lower surface of the stator 210.

An oil collecting hole 211 may be formed adjacent to and penetrate an edge of the stator 210 to pass oil collected in the internal space 101 of the shell 100 through the stator 210 into the lower cap 130. The oil collecting hole 211 may communicate with an oil collecting hole 146 of the lower frame 140.

The rotor 220, which may include a magnet 212, may be disposed at an inner circumferential surface of the stator 210 with a predetermined gap therebetween and may be coupled with the cylinder 410, which will be described later, at a center thereof. The rotor 220 and cylinder 410 may be coupled with an upper bearing plate (hereinafter, "upper bearing") 420 and/or a lower bearing plate (hereinafter, "lower bearing") 430, which will be described later, by, for example, a bolt. Further, the rotor 220 and cylinder 410 may be molded in an integrated manner using, for example, a sintering process.

As illustrated in FIGS. 1 through 3, the stationary shaft 300 may include a shaft portion 310 having a predetermined length in an axial direction, both ends of which may be fixed to the shell 100, and an eccentric portion 320 that extends eccentrically at a middle portion of the shaft portion 310 in a radial direction and accommodates the compression space 401 of the cylinder 410 to vary a volume of the compression space 401. The shaft portion 310 may be formed such that a center of the stationary shaft 300 corresponds to a rotational center of the cylinder 410 or a rotational center of the rotor 220 or a radial center of the stator 210 or a radial center of the shell 100, whereas the eccentric portion 320 may be formed such that the center of the stationary shaft 300 is eccentrically located with respect to the rotational center of the cylinder 410 or the rotational center of the rotor 220 or the radial center of the stator 210 or the radial center of the shell 100.

An upper end of the shaft portion 310 may be inserted into the accumulating chamber 501 of the accumulator 500, whereas a lower end of the shaft portion 310 may penetrate in an axial direction and be rotatably coupled with the upper bearing 420 and the lower bearing 430 to support the same in a radial direction.

A first suction guide hole 311, an upper end of which may communicate with the accumulating chamber 501 of the accumulator 500 to form the refrigerant suction passage 301, may be formed at an inner portion of the shaft portion 310 and having a predetermined depth in an axial direction, so as to extend nearly to a lower end of the eccentric portion 320, and a second suction guide hole 321, an end of which may communicate with the first suction guide hole 311 and the other end of which may communicate with the compression space 401, to form the refrigerant suction passage 301 together with the first suction guide hole 311, may penetrate the eccentric portion 320 in a radial direction.

Figure 6:
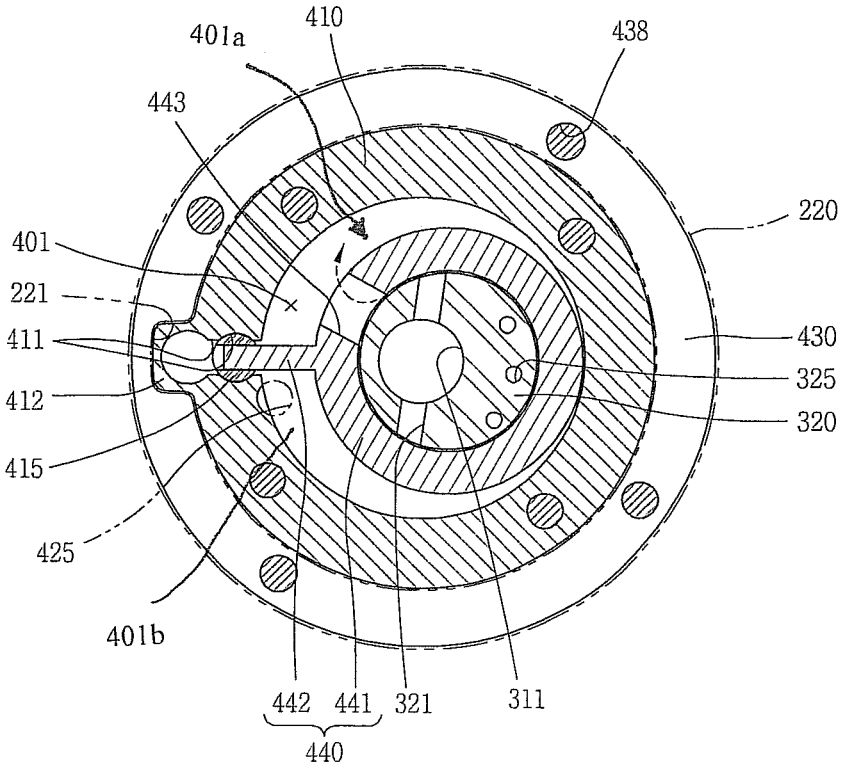
FIG. 6 is a cross-sectional view taken along line I-I of FIG. 5.

The second suction guide hole 321, which may form the refrigerant suction passage 301 together with the first suction guide hole 311, may penetrate an inner portion of the eccentric portion 320 in a radial direction. A plurality of second suction guide holes 321 may be formed in a straight line, as shown in FIG. 6; however, other arrangements may also be appropriate based on circumstances, for example, the second suction guide hole 321 may extend in only one direction with respect to the first suction guide hole 311.

A suction guide groove 322, which may be formed, for example, in a ring shape may be provided at an outer circumferential surface of the eccentric portion 320 to communicate refrigerant at all times with a suction port 443 of the roller vane 440, which will be described later, through the second suction guide hole 321. Alternatively, the suction guide groove 322 may also be formed at an inner circumferential surface of the roller vane 440, or may be formed at both an inner circumferential surface of the roller vane 440 and an outer circumferential surface of the eccentric portion 320. Further, the suction guide groove 322 may not necessarily be in a ring shape, but rather, may be also formed in a long circular arc shape in a circumferential direction, for example. Other shapes of the suction guide groove 322 may also be appropriate.

Figure 8:
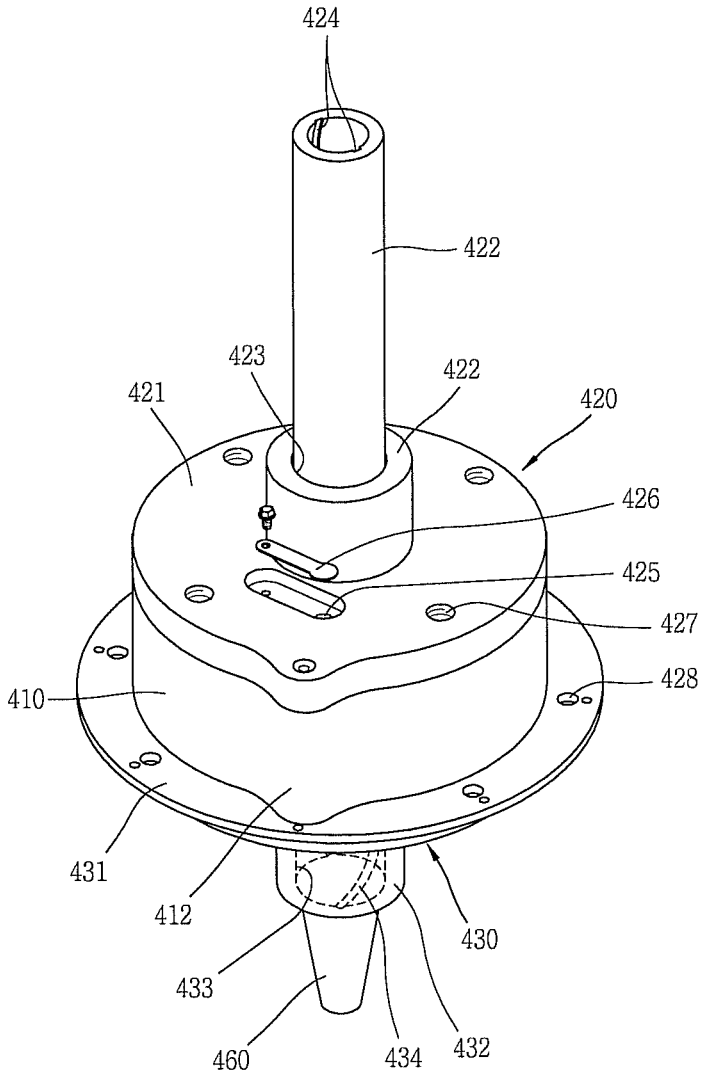
FIG. 8 is a perspective view of the compression device in the compressor of FIG. 1.
Figure 9:
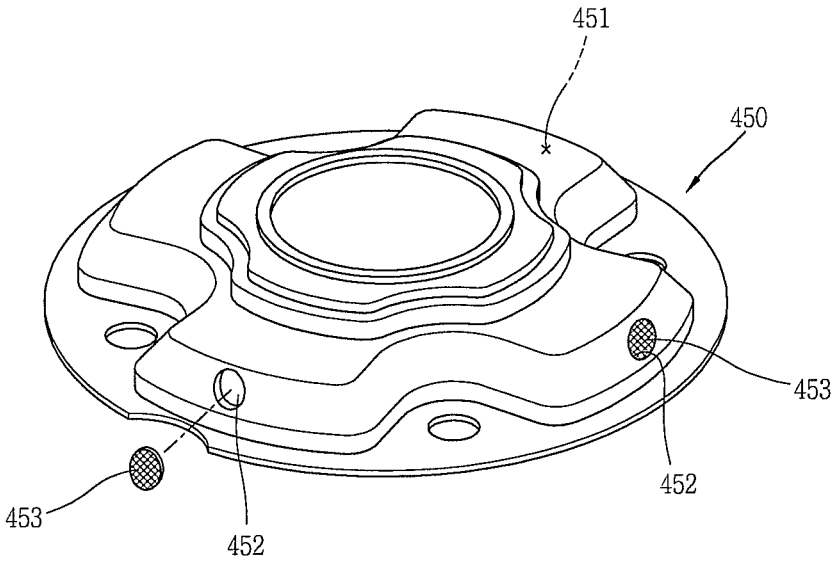
FIG. 9 is a perspective view of a muffler in the compressor of FIG. 1.

The compression device 400 may be coupled with the eccentric portion 320 of the stationary shaft 300 to compress refrigerant while being rotated together with the rotor 220. As illustrated in FIGS. 8 and 9, the compression device 400 may include the cylinder 410, the upper bearing 420 and the lower bearing 430 positioned at both sides of the cylinder 410, respectively, to form the compression space 401, and the roller vane 440 provided between the cylinder 410 and the eccentric portion 320 to compress refrigerant while varying the compression space 401.

Figure 16:
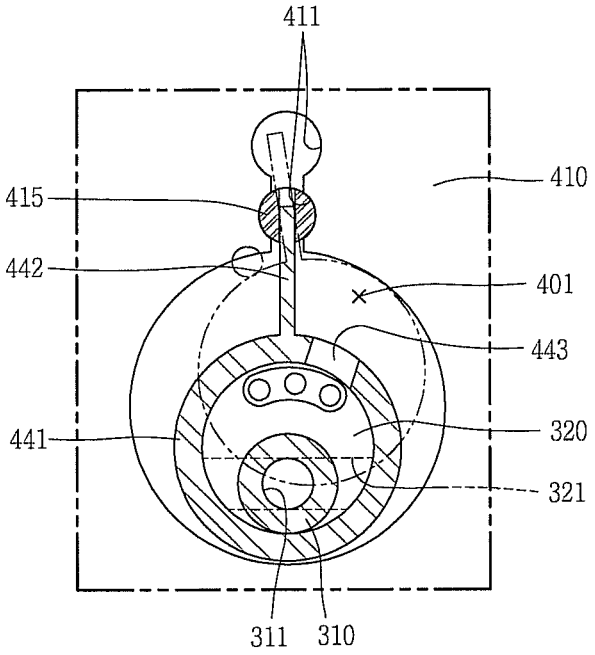
FIGS. 16 and 17 are plan views illustrating embodiments of the roller vane of FIG. 15.
Figure 17:
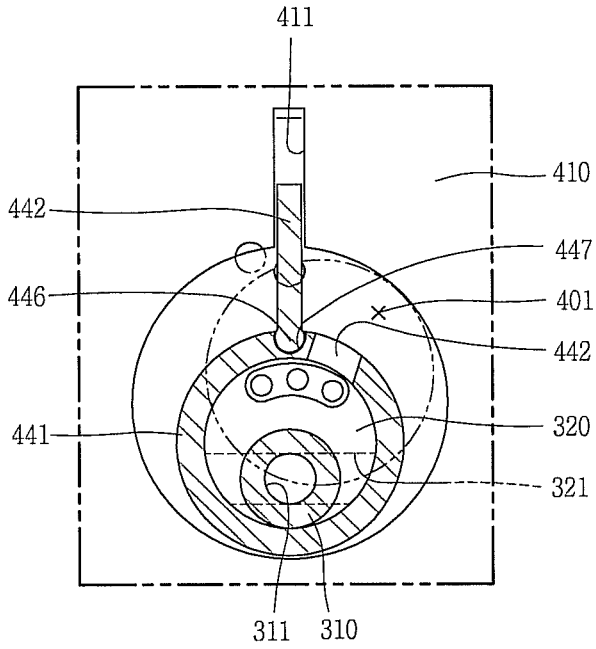

The cylinder 410 may be formed in, for example, a ring shape to form the compression space 401 therewithin. A rotational center of the cylinder 410 may be provided to correspond to an axial center of the stationary shaft 300. Further, a vane slot 411, into which the roller vane 440 may be slidably inserted in a radial direction while being rotated, may be formed at a side of the cylinder 410. The vane slot 411 may be formed in various shapes according to the shape of the roller vane. For example, a rotational bush 415 may be provided in the vane slot 411, such that a vane portion 442 of the roller vane may be rotationally moved in the vane slot 411, when a roller portion 441 and the vane portion 442 of the roller vane 440 are formed in an integrated manner, as illustrated in FIGS. 6 and 16. Further, the vane slot 411 may be formed in a slide groove shape, such that the vane portion 442 may be slidably moved in the vane slot 411 when the roller portion 441 and vane portion 442 are rotatably coupled with each other, as illustrated in FIG. 17.

An outer circumferential surface of the cylinder 410 may be inserted into the rotor 220 and coupled therewith in an integrated manner. For example, the cylinder 410 may be, for example, pressed to the rotor 220 or fastened to the upper bearing 420 or the lower bearing 430 using, for example, fastening bolts 402, 403.

When the cylinder 410 and upper bearing 420 are fastened by or to the lower bearing 430, an outer diameter of the lower bearing 430 may be formed larger than that of the cylinder 410, whereas an outer diameter of the upper bearing 420 may be formed to be approximately similar to that of the cylinder 410. Further, a first through hole 437 configured to fasten the cylinder 410 and a second through hole 438 configured to fasten the rotor 220 may be formed, respectively, on the lower bearing 430. The first through hole 437 and second through hole 438 may be formed on radially different lines to enhance a fastening force, but may also be formed on the same line based on assembly considerations. A fastening bolt 402 may pass through the lower bearing 430 and be fastened to the cylinder 410, and a fastening bolt 403 may pass through the upper bearing 420 (via first through hole 427) and be fastened to the cylinder 410. The fastening bolts 402 and 403 may be formed to have the same fastening depth.

Figure 7:
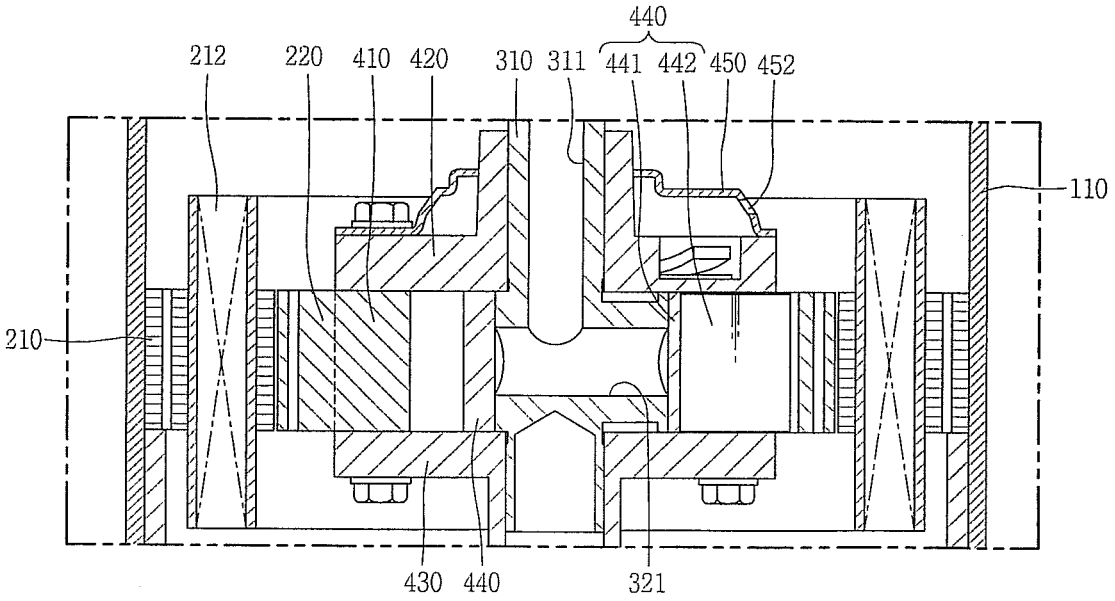
FIG. 7 is a cross-sectional view of a coupling between a cylinder and a rotor in the compressor of FIG. 1, according to another embodiment.

The cylinder 410 may be molded together with the rotor 220 in an integrated manner, as illustrated in FIG. 7. For example, the cylinder 410 and rotor 220 may be molded in an integrated manner through, for example, a powder metallurgy or die casting process. In this case, the cylinder 410 and rotor 220 may be formed using the same material, or different materials. When the cylinder 410 and rotor 220 are formed using different materials, the cylinder 410 may be formed of a material having a relatively high abrasion resistance in comparison to the rotor 220. Further, when the cylinder 410 and rotor 220 are formed in an integrated manner, the upper bearing 420 and the lower bearing 430 may be formed to have the same or a smaller outer diameter than that of the cylinder 410, as illustrated in FIG. 7.

As illustrated in FIG. 6, a protrusion portion 412 and a groove portion 221 may be formed at an outer circumferential surface of the cylinder 410 and an inner circumferential surface of the rotor 220, respectively, to enhance a combining force between the cylinder 410 and the rotor 220, as illustrated in FIG. 9. The vane slot 411 may be formed within a range of a circumferential angle formed by the protrusion portion 412 of the cylinder 410. A plurality of protrusion portions and groove portions may be provided. When a plurality of protrusion portions and groove portions are provided, they may be formed at a same interval along the circumferential direction to cancel out magnetic unbalance.

Figure 5:
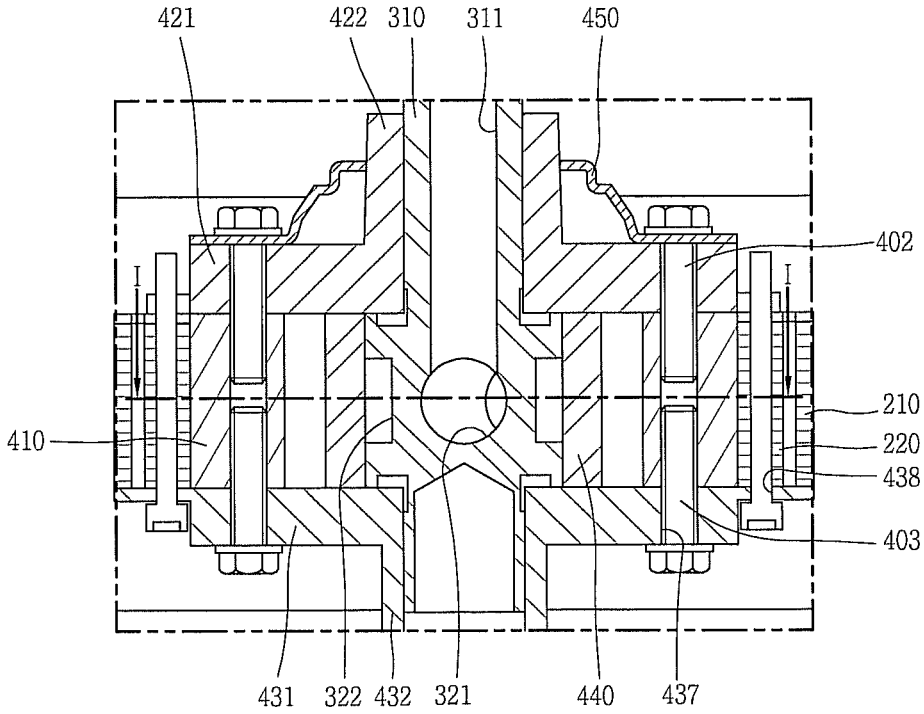
FIG. 5 is a cross-sectional view of the compression device of FIG. 1.

As illustrated in FIG. 5, the upper bearing 420 may be formed such that a shaft receiving portion 422 that supports the shaft portion 310 of the stationary shaft 300 in a radial direction protrudes upward a predetermined height at a center of an upper surface of the stationary plate portion 421. The rotor 220, the cylinder 410, and a rotating body including the upper bearing 420 and the lower bearing 430, which will be described later, may have a rotational center corresponding to an axial center of the stationary shaft 300. Thus, the rotating body may be efficiently supported even though the shaft receiving portion 422 of the upper bearing 420 or the shaft receiving portion 432 of the lower bearing 430 do not have as long a length.

The stationary plate portion 421 may be formed in a disc shape and may be fixed to an upper surface of the cylinder 410. A shaft receiving hole 423 of the shaft receiving portion 422 may be formed to be rotatably coupled with the stationary shaft 300. An oil groove 424, which will be described later, may be formed in, for example, a spiral shape at an inner circumferential surface of the shaft receiving hole 423.

A discharge port 425 may be formed at a side of the shaft receiving portion 422 to communicate with the compression space 401, and a discharge valve 426 may be formed at an outlet end of the discharge port 425. A muffler 450 that reduces discharge noise of refrigerant being discharged through the discharge port 425 may be coupled with an upper side of the upper bearing 420.

As illustrated in FIG. 9, at least one noise space 451 may be formed in the muffler 450, and an exhaust through hole 452 may be formed at a side of the noise space 451 to exhaust refrigerant into the internal space 101 of the shell 100. The exhaust through hole 452 may be in the form of a simple hole, and a separating member 453, such as a mesh, may be installed to separate oil from refrigerant discharged from the compression space 401.

Figure 10:
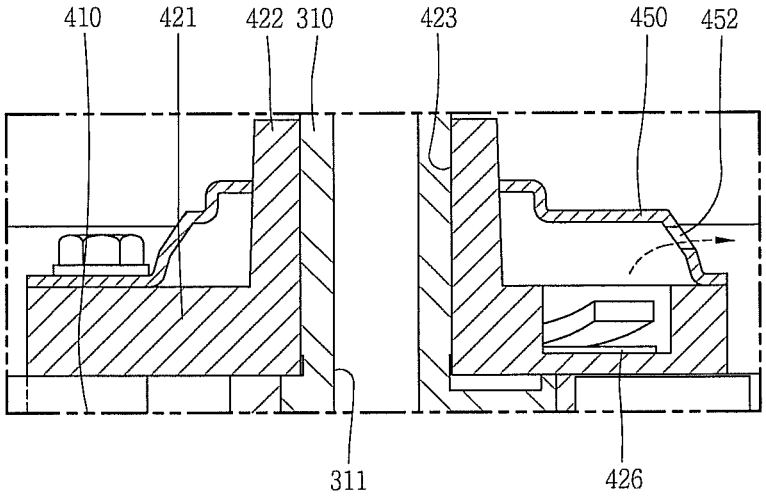
FIG. 10 is a cross-sectional view illustrating a state in which refrigerant is discharged through the muffler in the compressor of FIG. 1.
Figure 11:
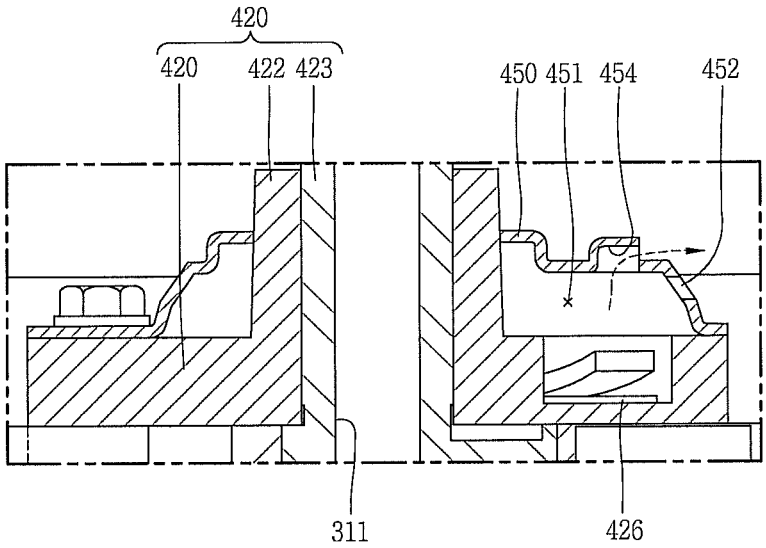
FIG. 11 is a cross-sectional view of a discharge structure of refrigerant in a muffler of the compressor of FIG. 10, according to another embodiment.

Further, the exhaust through hole 452 may penetrate in an axial direction, or may be formed in a radial direction to guide refrigerant being discharged from the compression space 401 to the internal space 101 of the shell body 110 in a direction of the coil 212, as illustrated in FIGS. 9 and 10, talking into consideration that the coil 212 of the stator 210 is disposed in a transverse direction outside of the muffler 450, thereby enhancing motor efficiency. In order to form the exhaust through hole 452 in a radial direction, the exhaust through hole 452 may penetrate a lateral surface of the noise space 451 facing an outer circumferential surface of the upper bearing 420, as illustrated in FIG. 10, and a guiding surface portion 454, which may be cut to be curved or inclined in a radial direction, may also be formed at an upper surface of the noise space 451, as illustrated in FIG. 11.

Figure 12:
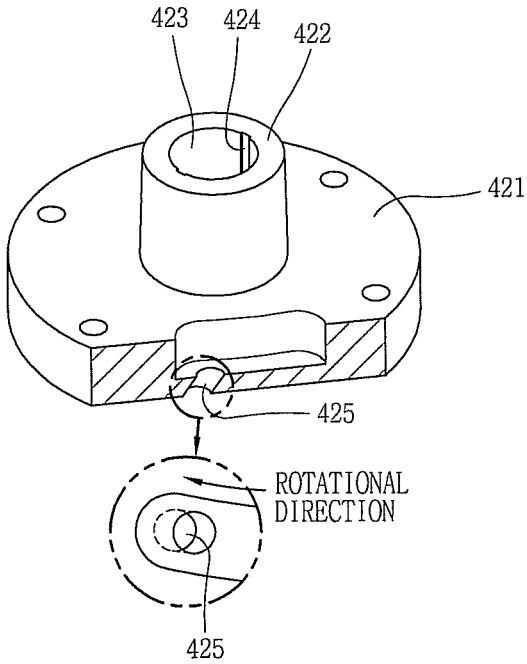
FIG. 12 is a partially fractured perspective view of a discharge port of an upper bearing in the compressor of FIG. 1.

The exhaust through hole 452 and discharge port 425 may be installed on the upper bearing 420 and muffler 450, which are both rotating bodies, and thus, the exhaust through hole 452 and discharge port 425 may be inclined or rounded in a forward rotational direction, as illustrated in FIG. 12, thereby reducing the discharge resistance.

As illustrated in FIGS. 5 and 8, the lower bearing 430 may be symmetrical to the upper bearing 420, such that a shaft receiving portion 432 that supports the shaft portion 310 of the stationary shaft 300 in a radial direction protrudes downward a predetermined height at a center of a lower surface of stationary plate portion 421. The rotor 220, the cylinder 410, and the rotating body including the upper bearing 420 and the lower bearing 430 may have a rotational center corresponding to an axial center of the stationary shaft 300, and thus, the rotating body may be efficiently supported, even though the shaft receiving portion 432 of the lower bearing 430 does not have as long a length as the shaft receiving portion 422 of the upper bearing 420.

The stationary plate portion 431, which may be formed in a disc shape, may be fixed to a lower surface of the cylinder 410, and a shaft receiving hole 433 of the shaft receiving portion 432 may be formed in a radial direction to be rotatably coupled with the stationary shaft 300. An oil groove 434, which will be described later, may be formed in a spiral shape at an inner circumferential surface of the shaft receiving hole 433.

When the cylinder 410 and rotor 220 are separately formed, the rotor 220 and the cylinder 410 may be coupled with each other by means of the stationary plate portion 431 of the lower bearing 430. Alternatively, the cylinder 410 and rotor 220 may be coupled in an integrated manner by means of the upper bearing 420.

Figure 13:
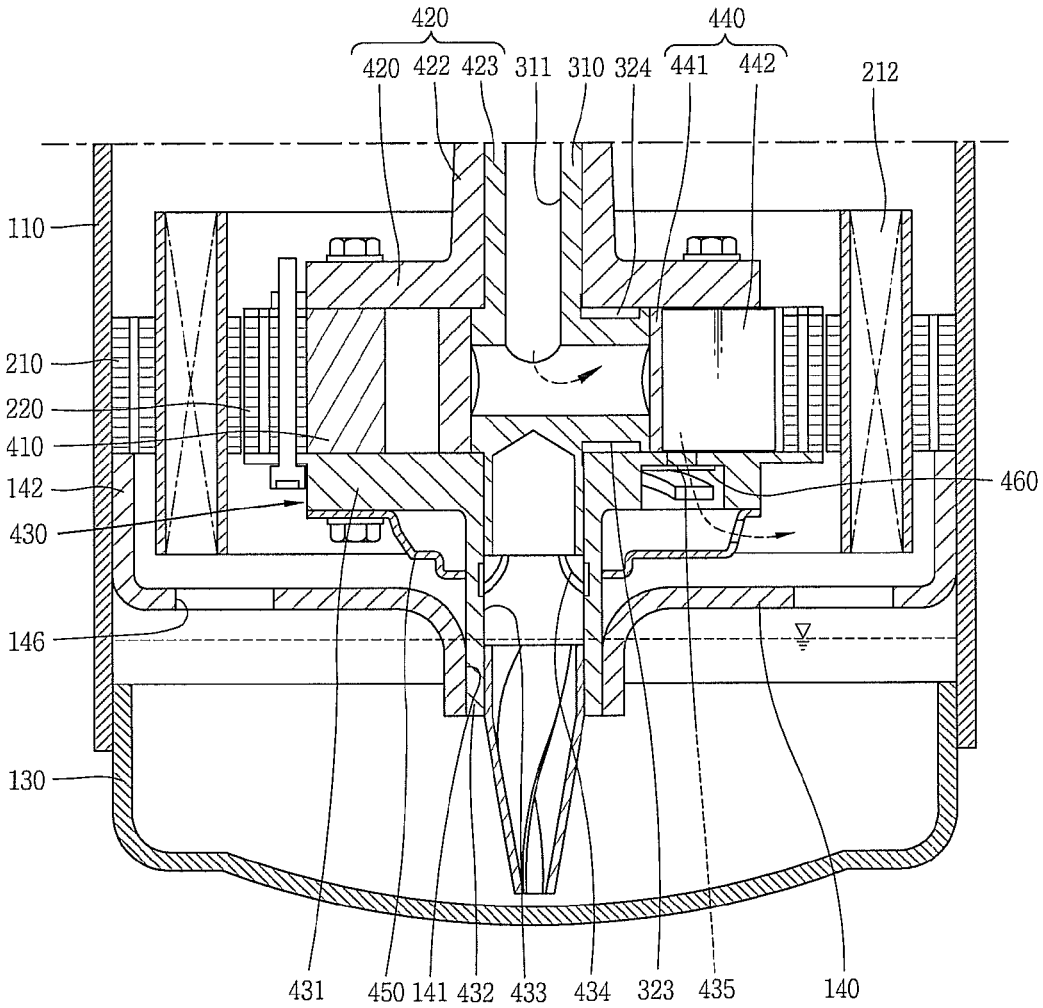
FIG. 13 is a cross-sectional view illustrating a structure in which refrigerant is discharged to a lower side through a lower bearing in the compressor of FIG. 1.

The discharge port may not be formed on the upper bearing 420, but rather, may be formed on the lower bearing 430, as illustrated in FIG. 13. In this case, the muffler 450 may be coupled with the lower bearing 430, and the exhaust through hole 452 of the muffler 450 may penetrate in an axial or radial direction the noise space 451. More particularly, when the discharge port 435 is formed on the lower bearing 430, refrigerant may interfere with oil stored when the exhaust through hole 452 of the muffler 450 penetrate in an axial direction, and thus, the exhaust through hole 452 may penetrate in a radial direction toward the coil to reduce interference between refrigerant and oil, or enhance a cooling effect of the coil.

Figure 14:
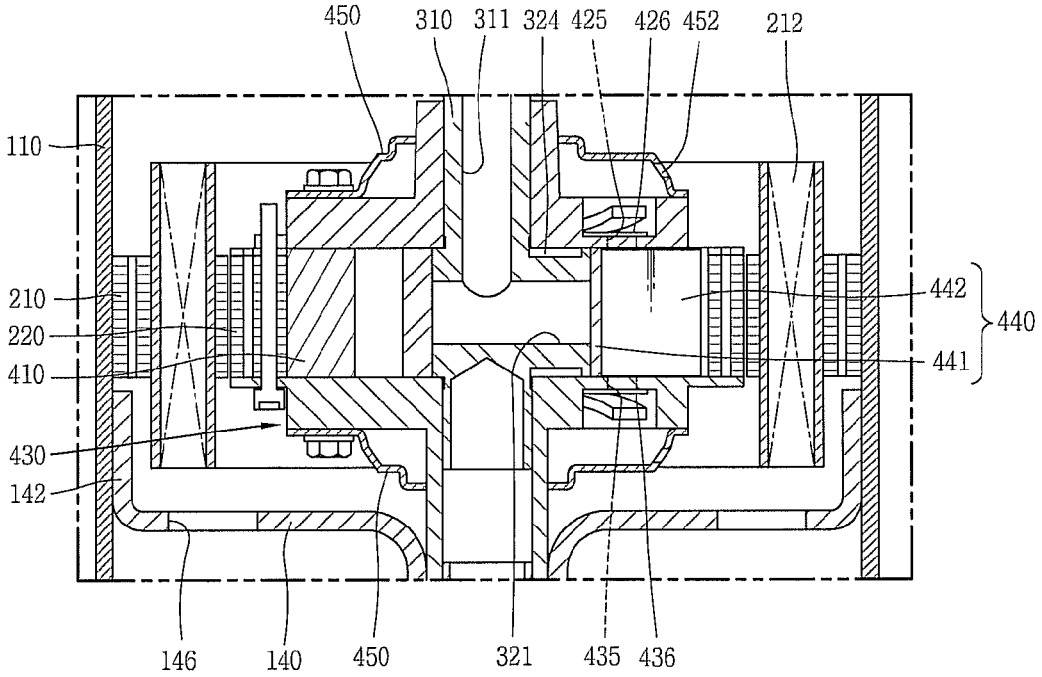
FIG. 14 is a cross-sectional view illustrating a structure in which refrigerant is discharged to both upper and lower sides through an upper bearing and a lower bearing in the compressor of FIG. 1.

Furthermore, the discharge ports 425, 435 may be formed on both the upper bearing 420 and lower bearing 430, respectively, as illustrated in FIG. 14. In this case, each discharge port 425, 435 formed on the upper bearing 420 and lower bearing 430, respectively, may be formed on the same vertical line, namely, at the same circumferential angle, but may also be formed at different circumferential angles, such that both the discharge ports 425, 435 have a phase difference in a circumferential direction in the case of a variable capacity compressor. Further, when the discharge ports 425, 435 are formed on both bearings 420, 430, the foregoing muffler 450 may be installed on each bearing 420, 430. Furthermore, when the discharge ports 425, 435 are formed at the same circumferential angle, discharge valves 426, 436 having the same elastic coefficient may be formed to discharge refrigerant from both the discharge ports 425, 435 at the same time, or discharge valves 426, 436 having different elastic coefficients may be formed to vary the capacity. Of course, even when the discharge ports 425, 435 are formed to have a phase difference, the discharge valves 426, 436 may be formed to have the same or different elastic coefficients.

Figure 15:
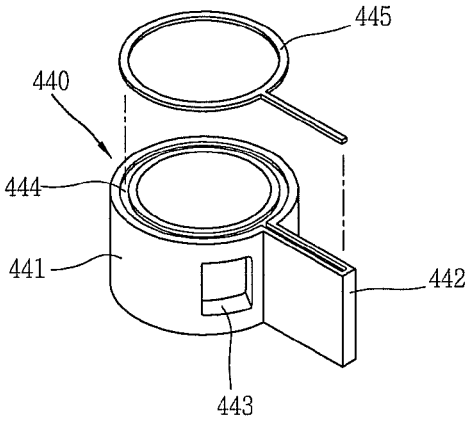
FIG. 15 is a perspective view of a roller vane in the compressor of FIG. 1.

As illustrated in FIG. 15, the roller vane 440 may include a roller portion 441 rotatably coupled with the eccentric portion 320 of the stationary shaft 300, and a vane portion 442 coupled or molded with the roller portion 441 in an integrated manner to be slidably inserted into the vane slot 411 of the shaft portion 310. Further, a sealing groove 444 may be formed at both top and bottom sides of the vane portion 442 of the roller portion 441, and a sealing member 445 may be inserted into the sealing groove 444 to prevent refrigerant being compressed from being leaked in an axial direction.

The roller portion 441 may be formed in, for example, a ring shape, such that part of the circumferential surface thereof may be brought into contact with an inner circumferential surface of the shaft portion 310, and the entire inner circumferential surface brought into contact with the eccentric portion 320. A suction port 443 that communicates with the second suction guide hole 321 of the eccentric portion 320 may be formed at a circumferential directional side around the vane portion 442, namely, an opposite side of the discharge port 425 of the upper bearing 420. However, when the suction guide groove 322 is formed in a ring shape at an outer circumferential surface of the eccentric portion 320 of the stationary shaft 300, the suction port 443 may continuously communicate with the second suction guide hole 321 through the suction guide groove 322. The suction guide groove may be formed at an inner circumferential surface of the roller vane 440, or the suction guide groove (not shown) may be formed at both surfaces.

The vane portion 442 may be formed in a rectangular parallelepiped shape, such that an end thereof may be molded at an outer circumferential surface of the roller portion 441, as illustrated in FIG. 16. In this case, the vane slot 411 may be formed with one or more circular grooves (for example, two vane slots are formed in a radial direction in the drawing), and one or more rotation bushes 415 may be rotatably inserted and coupled with the vane slot 411. An outer circumferential surface of the rotation bush 415 may be formed in, for example, a circular shape to be slidably rotated at an inner circumferential surface of the vane slot 411, and an inner circumferential surface of the rotation bush 415 may be formed on a plane to be slid in a lengthwise direction at both surfaces of the vane portion 442.

A revolving protrusion portion 446 may be formed in, for example, a circular cross-sectional shape at an end of the vane portion 442, as illustrated in FIG. 17, and a revolving groove portion 447 may be formed at an outer circumferential surface of the roller portion 441, such that the revolving protrusion portion 446 may be rotatably inserted and coupled therewith in a non-removable manner. In this case, a thin lubricating member (no reference numeral) having an abrasion resistance may be inserted between the revolving protrusion portion 446 and the revolving groove portion 447.

Figure 18:
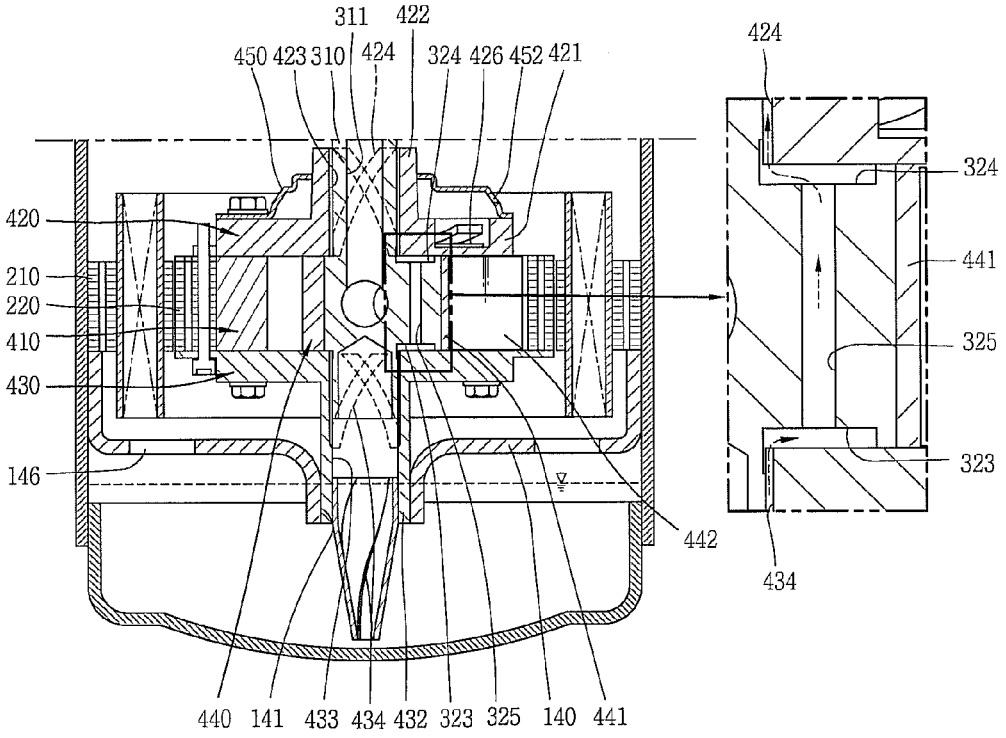
FIG. 18 is a cross-sectional view of an oil supply structure of the compression device in the compressor of FIG. 1.

As illustrated in FIGS. 1, 8 and 18, an oil feeder 460 that pumps oil collected in the lower cap 130 may be coupled with a lower end of the shaft receiving hole 433 of the lower bearing 430, and an outlet port of the oil feeder 460 may communicate with the oil groove 434 of the lower bearing 430. Further, a bottom oil pocket 323 may be formed at a bottom surface of the eccentric portion 320 that communicates with the oil groove 434 of the lower bearing 430, and one or more oil through hole(s) 325 that guides oil collected in the bottom oil pocket 323 to the oil groove 424 of the upper bearing 420 may penetrate in an axial direction at an inner portion of the bottom oil pocket 323. A top oil pocket 324 may be formed at a top surface of the eccentric portion 320 that communicate with the oil through hole(s) 325, and the top oil pocket 324 may communicate with the oil groove 424 of the upper bearing 420. A cross-sectional area of the bottom oil pockets 323, 324 may be broader than a total cross-sectional area of the oil through hole(s) 325, and the oil through hole(s) 325 may not overlap with the second suction guide hole 321, thereby efficiently moving refrigerant and oil.

The accumulator 500 may be formed at the internal space 101 of the shell 100, as the accumulator frame 150 is sealed and coupled with an inner circumferential surface of the shell body 110, as described above. For the accumulator frame 150, an edge of a circular plate body may be bent and an outer circumferential surface thereof may be attached to, for example, welded and coupled with a joint portion between the shell body 110 and the upper cap 120, while being closely adhered to an inner circumferential surface of the shell body 110 and an inner circumferential surface of the upper cap 120, to seal the accumulating chamber 501 of the accumulator 500.

A compressor having the foregoing configuration according to embodiments may be operated as follows.

When the rotor 220 is rotated by applying power to the stator 210 of the drive motor 200, the cylinder 410 coupled with the rotor 220 through the upper bearing 420 or the lower bearing 430 may be rotated with respect to the stationary shaft 300. Then, the roller vane 440 slidably coupled with the cylinder 410 may generate a suction force as it divides the compression space 401 of the cylinder 410 into a suction chamber 401*a* and a discharge chamber 401*b*.

Then, refrigerant may be inhaled into the accumulating chamber 501 of the accumulator 500 through the suction pipe 102, and the refrigerant divided into gas refrigerant and liquid refrigerant in the accumulating chamber 501 of the accumulator 500. The gas refrigerant may be inhaled into the suction chamber of the compression space 401 through the first suction guide hole 311 and second suction guide hole 321 of the stationary shaft 300, the suction guide groove 322, and the suction port 443 of the roller vane 440. The refrigerant inhaled into the suction chamber may be compressed while being moved to the discharge chamber by the roller vane 440 as the cylinder 410 continues to be rotated, and discharged to the internal space 101 of the shell 100 through the discharge port 425, and the refrigerant discharged to the internal space 101 of the shell 100 may repeat a series of processes to be discharged to a cooling cycle apparatus through the discharge pipe 103. At this time, oil in the lower cap 130 may be pumped by the oil feeder 460 provided at a lower end of the lower bearing 430, while the lower bearing 430 may be rotated at high speed together with the rotor 220, and passed sequentially through the oil groove 434 of the lower bearing 430, the bottom oil pocket 323, the oil through hole(s) 325, the top oil pocket 324, and the oil groove 424 of the upper bearing 420, to be supplied to each sliding surface.

Hereinafter, an assembly sequence of a compressor according to embodiments will be described below.

In a state in which the stator 210 and the lower frame 140 of the drive motor 200 are fixed to the shell body 110 in, for example, a shrink-fitting manner, the stationary shaft 300 may be inserted into the stationary bush 160 to be fixed, for example, by means of the fixing pin 168. The rotor 220, the cylinder 410, and the bearings 420, 430 may be coupled with the stationary shaft 300.

Next, in a state of maintaining a concentricity of the stator 210 and rotor 220, the accumulator frame 150 may be inserted into the shell body 110 to fasten the stationary bush 160 to the accumulator frame 150, and the accumulator frame 150 may be, for example, three-point welded to the shell body 110 for a temporary fix.

Then, the lower cap 130 may be, for example, pressed to the second open end 112 of the shell body 110 and a joint portion between the lower cap 130 and the shell body 110 may be, for example, circumferentially welded to be hermetically sealed.

Next, the upper cap 120 may be, for example, pressed to the upper open end of the shell body 110 and a joint portion between the upper cap 120 and the shell body 110 may be, for example, circumferentially welded together with the accumulator frame 150 to seal the internal space 101 of the shell 100, while forming the accumulating chamber 501 of the accumulator 500.

As described above, an internal space of the shell may be used as the accumulator, which may be installed in the internal space of the shell, thereby reducing a size of the compressor including the accumulator.

Further, the assembly process of the accumulator and the assembly process of the shell may be unified to simplify the assembly process of the compressor. Further, an accumulating chamber of the accumulator may be directly connected to a refrigerant suction passage of the stationary shaft by coupling the stationary shaft with the accumulator to prevent leakage of refrigerant from occurring, thereby enhancing compressor performance. Furthermore, an area required for installing the compressor may be minimized when installing the compressor including the accumulator in an outdoor device, thereby enhancing design flexibility of the outdoor device.

A center of gravity of the accumulator may be placed at a location corresponding to that of the entire compressor including the accumulator, thereby reducing vibration noise of the compressor due to the accumulator.

Also, an eccentric portion for forming a compression space in the stationary shaft may be provided, while an axial center of the stationary shaft may correspond to a rotational center of the cylinder, thereby securing a spacious compression space and increasing compressor capacity.

Both ends of the stationary shaft may be supported by a frame fixed to the shell, thereby effectively suppressing movement of the stationary shaft due to vibration generated during rotation of the rotational body, and reducing compressor vibration to enhance durability and reliability of the compressor, as well as reducing bearing usage to decrease material cost.

Interference with other components due to the compressor may be minimized to allow the compressor having a weight relatively higher than that of other components to be installed at a center of gravity of an outdoor device, thereby facilitating movement and installation of the outdoor device.

Another embodiment of an accumulator in a compressor will be described hereinbelow.

Figure 19:
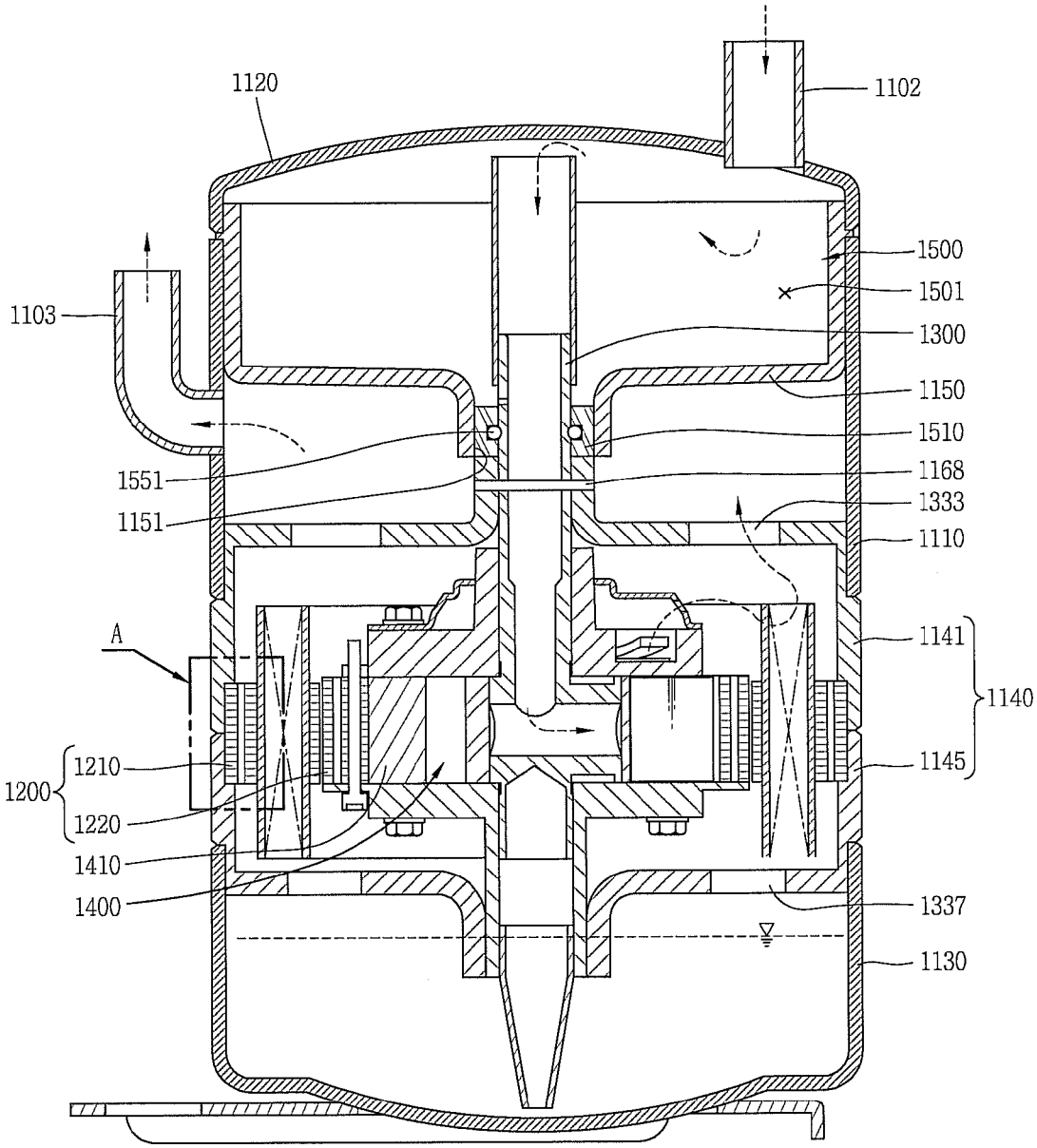
FIG. 19 is a cross-sectional view of a compressor according to another embodiment.

According to the foregoing embodiment, the stator 210 and the accumulator frame 150 may be fixed in, for example, a shrink-fitting manner at the same time to an inner circumferential surface of the shell 100; however, according to this embodiment, the stator 1210 may be inserted and fixed to the shell 1100, as illustrated in FIG. 19.

The shell 1100 may include an upper shell 1110, a lower shell 1130, and a middle shell 1140 located between the upper shell 1110 and lower shell 1130. The drive motor 1200 and compression device 1400 may be installed together in the middle shell 1140, and the driving shaft 1300 may penetrate and be coupled with the middle shell 1140.

1The upper shell 1110 may be formed in, for example, a cylindrical shape, and a lower end thereof may be coupled with an upper frame 1141 of the middle shell 1140, which will be described later, whereas an upper end thereof may be coupled with an upper cap 1120. Further, a suction pipe 1102 may be coupled with the upper shell 1110, and an accumulator frame 1150 may be coupled with an inner circumferential surface of the upper shell 1110 to form an accumulating chamber 1501 of the accumulator 1500 together with the upper cap 1120.

A bush hole 1151 may be formed at a center of the accumulator frame 1150. A sealing bush 1510 may be provided between an inner circumferential surface of the bush hole 1151 and an outer circumferential surface of the stationary shaft 1300. A sealing member 1551 may be inserted into an inner circumferential surface of the sealing bush 1510 to seal the accumulating chamber 1501 of the accumulator 1500.

The bush hole 1151 may protrude and extend downward in the form of a burr. Further, an upper end of the stationary shaft 1300 may be positioned adjacent to an upper surface of the accumulator frame 1150. A separate extension pipe 1310 may be connected to an upper end of the stationary shaft 1300. The separate extension pipe 1310 may have an inner diameter greater than that of the stationary shaft 1300 (i.e., an inner diameter of the refrigerant suction passage) to reduce suction loss.

The lower shell 1130 may be formed in, for example, a cup shape, such that an upper end thereof is open and a lower end thereof closed. The open upper end may be coupled with a lower frame 1145, which will be described later.

Figure 20:
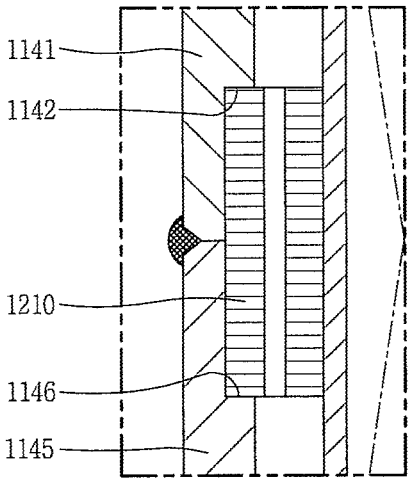
FIG. 20 is an enlarged cross-sectional view of a stator fixing structure in the compressor of FIG. 19, according to another embodiment.

The middle shell 1140 may be divided into an upper frame 1141 and a lower frame 1145 with respect to the stator 1210 of the drive motor 1200. Further, as illustrated in FIG. 20, grooves 1142, 1146 may be formed at a bottom end of the upper frame 1141 and a top end of the lower frame 1145, respectively, that face each other, which allowing lateral surfaces of the stator 1210 to be inserted and supported thereby. Further, a communication hole 1333 that guides refrigerant discharged from the compression device 1400 may be formed on the upper frame 1141, and an oil hole 1337 that collects oil may be formed on the lower frame 1145.

The other basic configuration and working effects thereof in a compressor according to this embodiment as described above may be substantially the same as the foregoing embodiment. However, according to this embodiment, the stator 1210 may be inserted and fixed between the upper frame 1141 and the lower frame 1145 forming part of the shell, and thus, easily assembled based on a concentricity between the stator 1210 and driving shaft 1300. In other words, according to this embodiment, the stator 1210 may be mounted on the groove 1146 of the lower frame 1145, then the driving shaft 1300 coupled with the rotor 1220 and cylinder 1410 may be inserted into the stator 1210, and the upper frame 1141 inserted onto the stationary shaft 1300 to support an upper surface of the stator 1210 via the groove 1142 of the upper frame 1141. The upper frame 1141 and the lower frame 1145 may be attached, for example, welded and coupled with each other, and the upper shell 1110 coupled with the accumulator frame 1150 may be inserted into the upper frame 1141, which may be attached, for example, welded to the upper shell 1110. Prior to attaching the upper frame 1141 to the lower frame 1145, a gap maintaining member, such as a gap gauge, may be inserted between the stator 1210 and the rotor 1220, and then the upper shell 1110 may be adjusted in a radial direction. As a result, the stationary shaft 1300 may maintain a concentricity with respect to the stator 1210. Accordingly, components may be easily assembled based on a concentricity of the stationary shaft when compared to the method of fastening and fixing the stationary bush to the accumulator frame, while adjusting the stationary bush in a radial direction in a state in which the gap maintaining member is inserted between the stator and rotor, as described.

According to this embodiment, the stationary shaft 1300 may be supported in an axial direction with respect to the upper frame 1141 using a stationary member 1168, such as a fixing pin, a fixing bolt, or a fixing ring, that passes through the upper frame 1141 and stationary shaft 1300. However, the stationary shaft 1300 may be supported in an axial direction by supporting a lower end of the bush hole 1151 of the accumulator frame 1150 with the upper frame 1141. In this case, the sealing bush 1510 may be, for example, pressed and fixed to the bush hole 1151 of the accumulator frame 1150, and the stationary shaft 1300 may be, for example, pressed to the sealing bush 1510 or fixed using another stationary member.

Still another embodiment of a compressor will be described hereinbelow.

According to the foregoing embodiment, the accumulator includes an accumulating chamber which forms part of the shell, namely, an upper cap, but according to this embodiment, the accumulator may be formed to have a separate accumulating chamber in the internal space of the shell and coupled with an inner circumferential surface of the shell to be separated by a predetermined distance.

Figure 21:
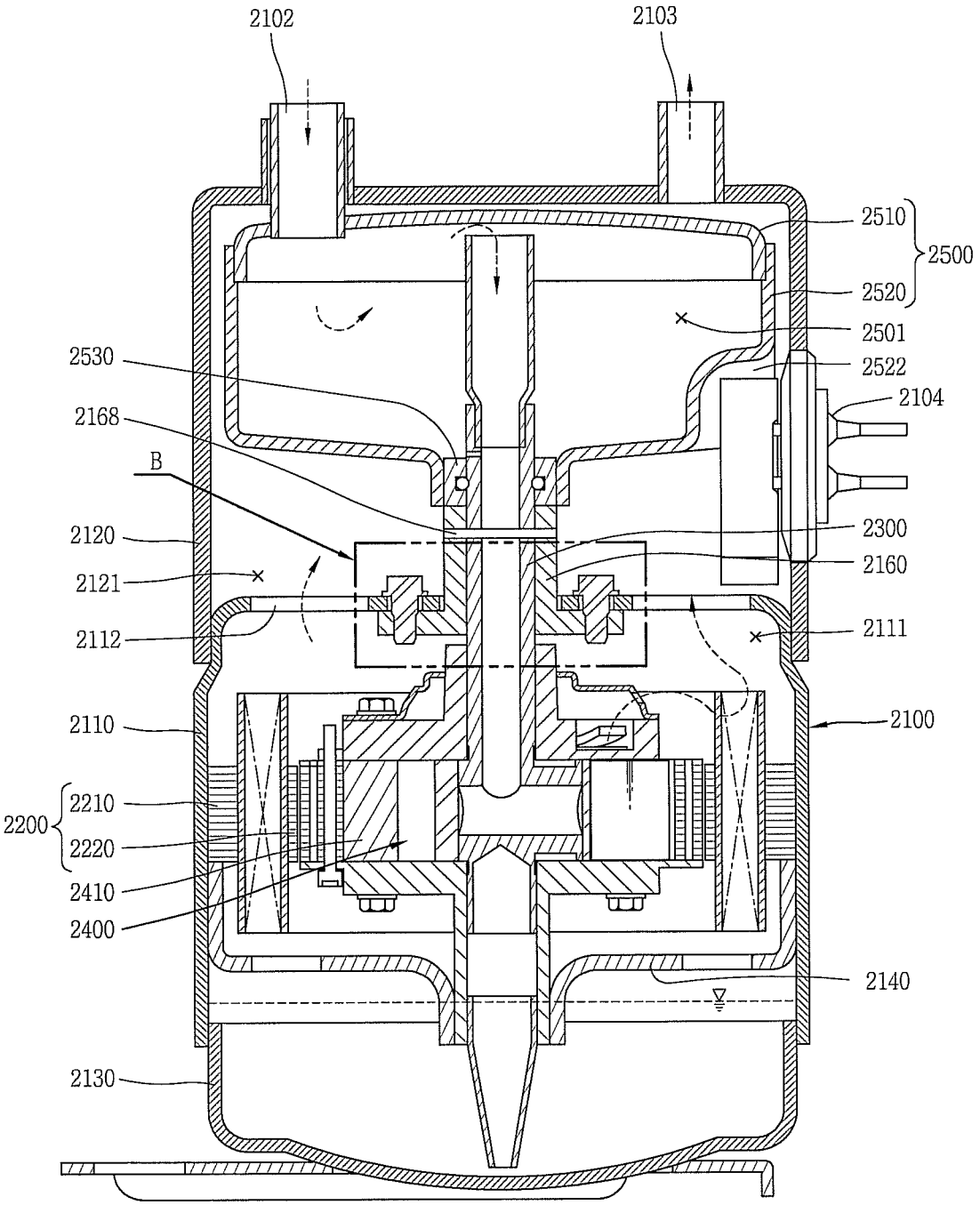
FIG. 21 is a cross-sectional view of a compressor according to another embodiment.

As illustrated in FIG. 21, according to this embodiment, the drive motor 2200 and compression device 2400 may be installed in the shell body 2110, a lower end of which may be open to form part of the shell 2100. A lower end of the shell body 2110 may be sealed by the lower cap 2130. A top shell 2120 may be coupled with an upper end of the shell body 2110, and a communication hole 2112 may be formed at an upper surface of the shell body 2110, such that the internal space 2111 of the shell body 2110 may communicate with the internal space 2121 of the top shell 2120. Further, the stationary shaft 2300 may be inserted into a center of the shell body 2110 to fasten the stationary bush 2160 by means of, for example, the fixing pin 2168. The accumulator 2500 separated by a predetermined distance to have a separate accumulating chamber 2501 in the internal space of the top shell 2120 may be coupled with an upper end of the stationary shaft 2300. The accumulator 2500 may be fixed to the shell by means of a suction pipe 2102 that passes through the top shell 2120 to be coupled therewith.

Figure 22:
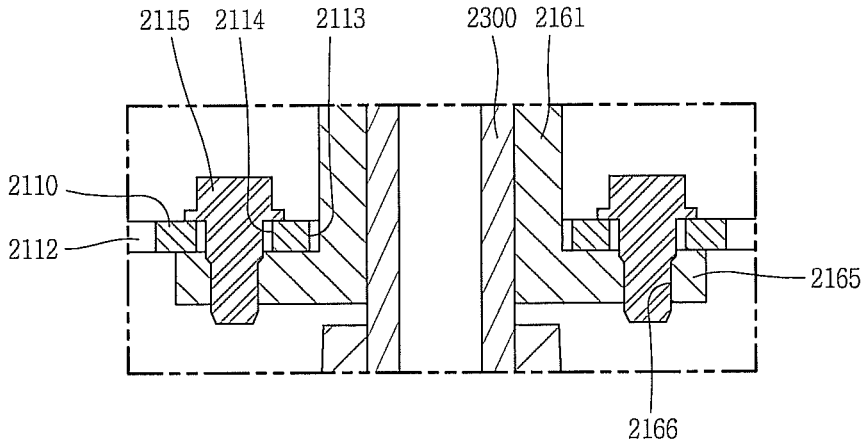
FIG. 22 is a cross-sectional view of an assembly structure of a stationary bush that controls a concentricity of a stationary shaft in the compressor of FIG. 21.

As illustrated in FIG. 22, the bush hole 2113 may be formed at the shell body 2110 and pass through the shaft receiving portion 2161 of the stationary bush 2160, and the through hole 2114 configured to fasten the stationary bush 2160 with the bolt 2115 may be formed adjacent to the bush hole 2113. Further, a fastening hole 2166 may be formed at a flange portion 2165 of the stationary bush 2160 to correspond to the through hole 2114. An inner diameter of the bush hole 2113 may be larger than that of the shaft receiving portion 2161, while a diameter of the through hole 2114 may be larger than that of the fastening hole 2166, thereby facilitating assembly based on a concentricity of the stationary shaft 2300.

The stator 2210 of the drive motor 2200 may be, for example, shrink-fitted and fixed to the shell body 2110. The lower frame 2140, which may support a lower end of the stationary shaft 2300, while at the same time supporting the stator 2210, may be, for example, shrink-fitted and fixed to a lower end of the stator 2210.

A discharge pipe 2103 that communicates with the internal space 2121 of the top shell 2120 to discharge compressed refrigerant to the cooling cycle apparatus may be coupled with a surface through which the suction pipe 2102 penetrates.

The accumulator 2500 may be coupled with the upper housing 2510 and the lower housing 2520 to be sealed to each other to form an accumulating chamber 2501, which may be separated from the internal space 2121 of the top shell 2120.

A bush hole 2521 may be formed at a center of the lower housing 2520, and a sealing bush 2530 inserted into the stationary shaft 2300 may be fixed to the bush hole 2521.

Figure 23:
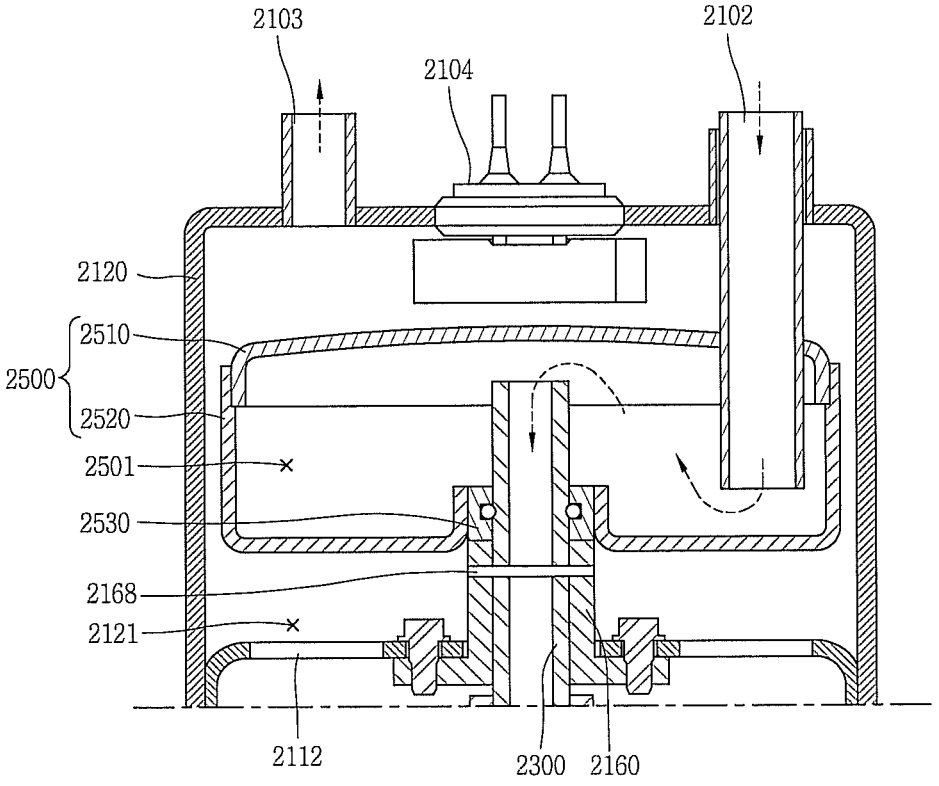
FIG. 23 is a cross-sectional view of an assembly position of a terminal in the compressor of FIG. 21, according to another embodiment.

A terminal mounting portion 2522 may be formed in a depressed manner, such that a terminal 2104 may be coupled with a side wall surface of the top shell 2120. The terminal 2104 may be installed at an upper surface of the top shell 2120, as illustrated in FIG. 23. A separate terminal mounting portion may not be necessary at a side wall surface of the accumulator 2500, and the sealing bush 2130 may be accommodated in the accumulating chamber 2501 of the accumulator 2500, thereby preventing a height of the compressor from being increased due to the terminal 2104.

The other basic configuration and working effects thereof in a compressor according to this embodiment as described above may be substantially the same as the foregoing embodiment. However, according to this embodiment, as the accumulator 2500 is separated from the shell 2100, heat transferred through the shell 2100 may be prevented from being directly transferred to a suction refrigerant, and vibration due to a pulsating pressure generated when absorbing refrigerant may be prevented from being transferred to the shell.

In addition, the rotor 2220 and cylinder 2410 including the stationary shaft 2300 may be located at an inner portion of the stator 2210, and the stationary bush 2160 may be fastened to the shell body 2110 based on a concentricity of the stationary shaft 2300, thereby facilitating assembly based on a concentricity between the stationary shaft 2300 and stator 2210.

Moreover, the suction pipe 2102, the discharge pipe 2103, and the terminal 2104 may be disposed on the same plane, thereby further reducing an area occupied by the compressor and further enhancing design flexibility of an outdoor device employing the compressor.

Still another embodiment of a compressor will be described hereinbelow.

According to the foregoing embodiment, the accumulator may be installed to form an internal volume using a portion of the shell at an inner portion of the shell or may be separated from an inner circumferential surface of the shell by a predetermined distance to separately form an internal volume; however, according to this embodiment, the accumulator may be installed to form an internal volume using the shell at an outer portion of the shell.

Figure 24:
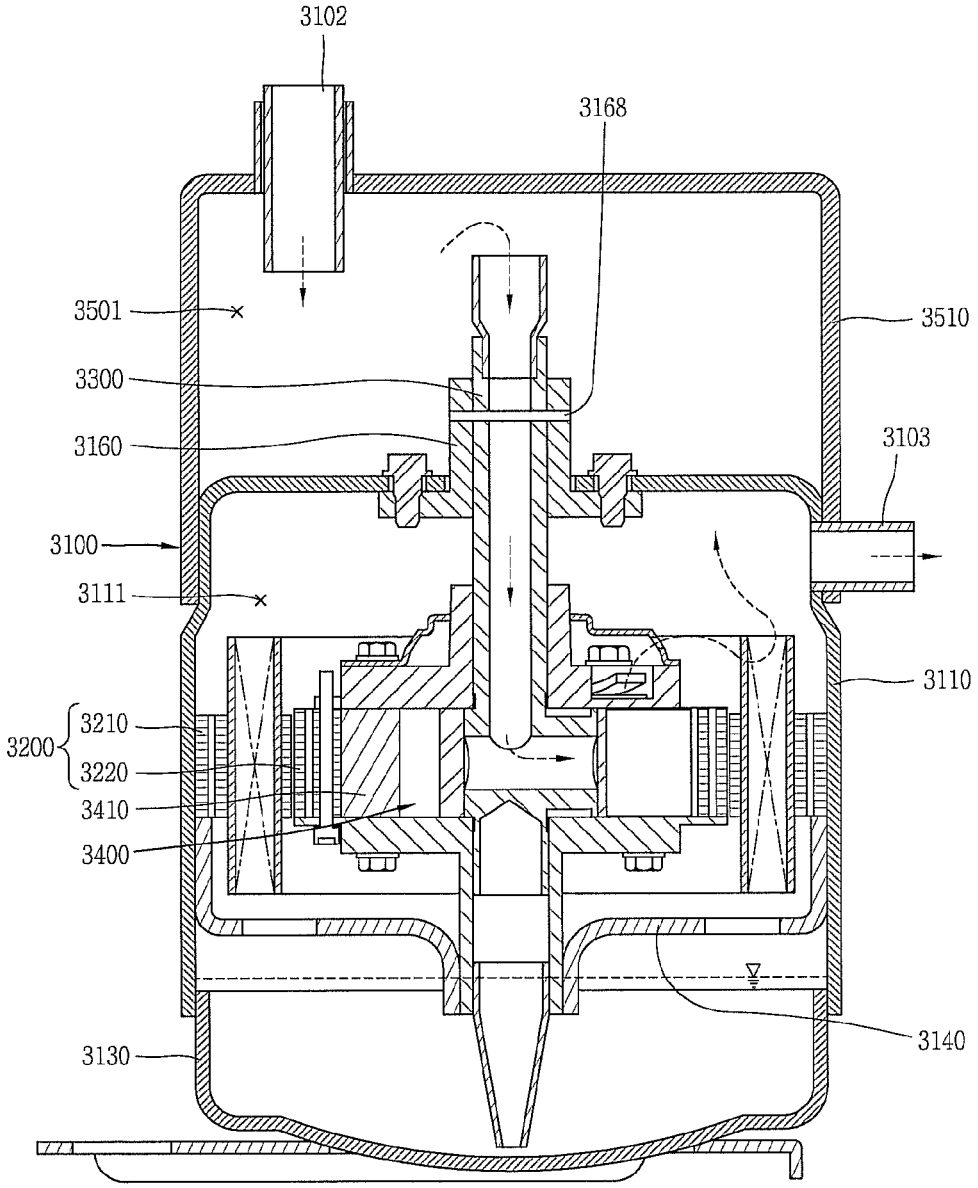
FIG. 24 is a cross-sectional view of a compressor according to still another embodiment.

As illustrated in FIG. 24, according to this embodiment, the drive motor 3200 and compression device 3400 may be installed in the shell body 3110, a lower end of which may be open to form part of the shell 3100. A lower end of the body shell 3110 may be sealed by the lower cap 3130. An accumulator cover 3510 may be coupled with an upper end of the shell body 3110 to form the accumulator 3500, and an upper surface of the shell body 3110 may be formed in a sealed shape to separate an internal space 3111 of the shell body 3110 from the accumulating chamber 3501 of the accumulator cover 3510. A stationary bush 3160 inserted and fixed by the stationary shaft 3300 may be fastened to a center of the shell body 3110, and the stationary shaft 3300 may be supported by, for example, a fixing pin 3168 that passes through the stationary shaft 3300 and the stationary bush 3160 in a radial direction.

Further, a suction pipe 3102 may communicate and be coupled with an upper surface of the accumulator cover 3510, and an discharge pipe 3103 that discharges refrigerant from the compression space of the compression device 3400 to a cooling cycle apparatus may communicate and be coupled with a radial directional surface of the shell body 3110.

Furthermore, the stator 3210 of the drive motor 3200 may be, for example, shrink-fitted and fixed to the shell body 3110, and the lower frame 3140, which may support a lower end of the stationary shaft 3300, while at the same time supporting the stator 3210, may be, for example, shrink-fitted and fixed to a lower end of the stator 3210.

The other basic configuration and working effects thereof in a compressor according to this embodiment as described above, may be substantially the same as the foregoing embodiment. However, according to this embodiment, the accumulator cover 3510 forming the accumulator 3500 may be coupled with an outer surface of the shell body 3110 forming the shell to facilitate assembly of the accumulator. Moreover, the rotor 3220 and cylinder 3410 including the stationary shaft 3300 may be located at an inner portion of the stator 3210, and then the stationary bush 3160 may be fastened to the shell body 3110 based on a concentricity of the stationary shaft 3300 to facilitate assembly based on a concentricity between the stationary shaft 3300 and stator 3210.

In addition, a thickness of the accumulator cover 3510 forming the accumulator 3500 may be less than that of the shell body 3110 and lower cap 3130, and a height of the shell 3100 having a relatively higher thickness may be decreased to reduce a weight of the entire compressor. Further, as the accumulator 3500 is installed at an outer portion of the shell 3100, refrigerant inhaled into the accumulating chamber 3501 of the accumulator 3500 may be quickly dissipated, thereby reducing a specific volume of the inhaled refrigerant and enhancing compressor performance.

Still another embodiment of a compressor will be described hereinbelow.

According to the embodiment of FIG. 24, the accumulator may be formed at an outer portion of the shell using an outer surface of the shell to form an accumulating chamber; however, according to this embodiment, the accumulator may be installed to have a predetermined distance at an outer portion of the shell.

Figure 25:
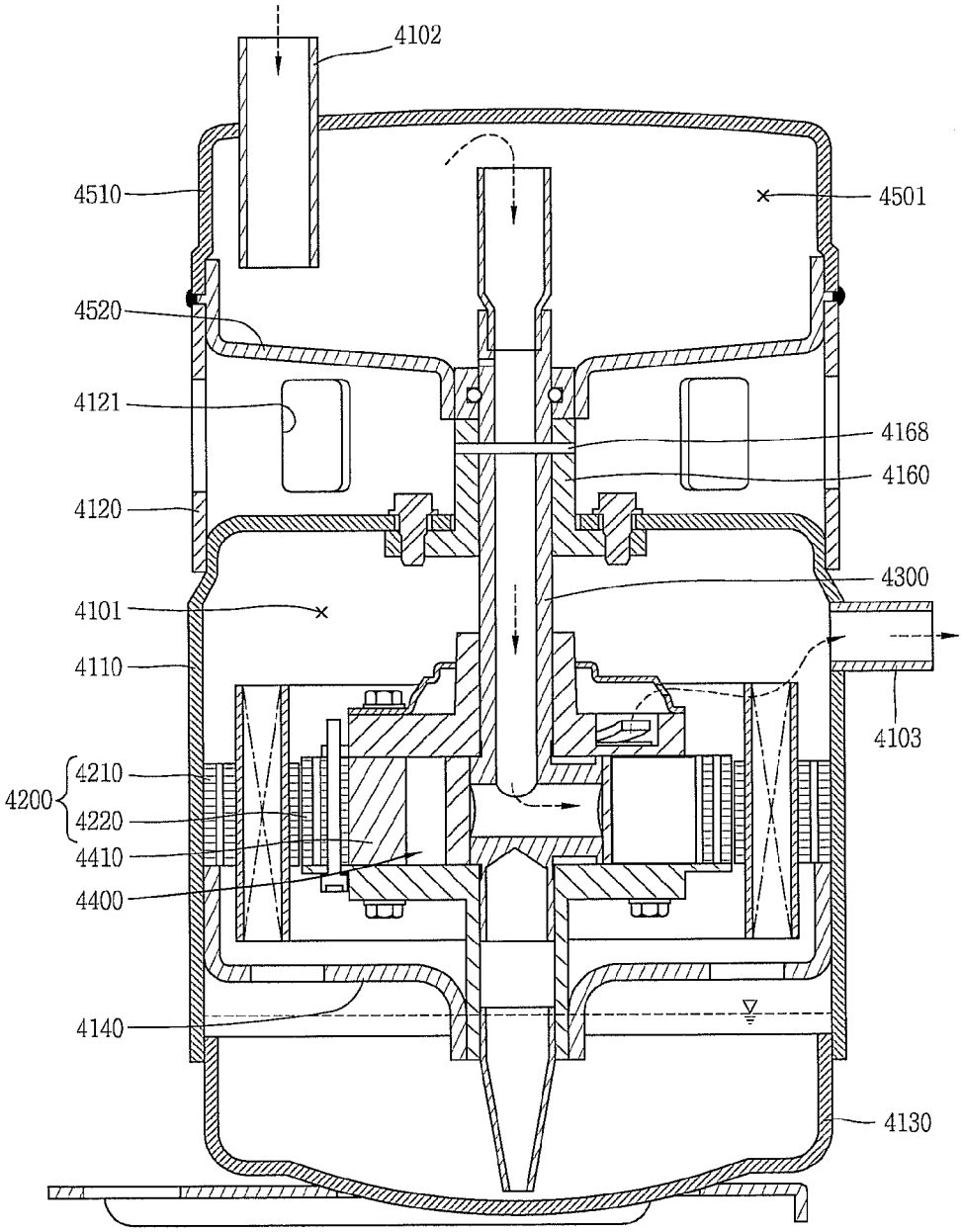
FIG. 25 is a cross-sectional view of a compressor according to still another embodiment.

As illustrated in FIG. 25, according to this embodiment, the drive motor 4200 and compression device 4400 may be installed in the shell body 4110, a lower end of which may be open to form part of the shell 4100. A lower end of the shell body 4110 may be sealed by the lower cap 4130.

Further, an accumulator 4500 having a separate accumulating chamber 4501 may be disposed at an upper side of the shell body 4110 to have a predetermined distance, and an upper end of the stationary shaft 4300 may be coupled with the accumulator 4500.

Furthermore, the accumulator 4500 may be coupled with an upper cover 4120, which may be inserted into and coupled with an outer circumferential surface of the upper side of the shell body 4110. The upper cover 4120 may be formed in, for example, a cylindrical shape, such that both open ends thereof may be attached, for example, welded and coupled with the shell body 4110 and the accumulator 4500, respectively. As an upper end of the shell body 4110 is formed in a closed shape, a plurality of through holes 4121 may be formed to allow an internal space formed by the upper cover 4120 to communicate with the outside.

A stationary bush 4160 inserted and fixed by the stationary shaft 4300 may be fastened to a center of the shell body 4110, and the stationary shaft 4300 may be supported by, for example, a fixing pin 4168 that passes through the stationary shaft 4300 and the stationary bush 4160 in a radial direction.

The upper housing 4510 and the lower housing 4520 to be sealed to each other to form an accumulating chamber 4501 separate from the internal space 4101 of the shell 4100.

A suction pipe 4102 may communicate and be coupled with an upper surface of the accumulator 4500, and a discharge pipe 4103 that discharges refrigerant being discharged from the compression space of the compression device 4400 to a cooling cycle apparatus may communicate and be coupled with a radial directional surface of the shell body 4110. The suction pipe 4102 need not necessarily communicate with an upper surface of the accumulator 4500, but may also be installed to communicate in parallel with the discharge pipe 4103. In addition, the discharge pipe 4103 need not necessarily communicate with a side wall surface of the shell body 4110, but may also communicate with an upper surface of the shell body 4110.

The stator 4210 of the drive motor 4200 may be, for example, shrink-fitted and fixed to the shell body 4110, and the lower frame 4140, which supports a lower end of the stationary shaft 4300, while at the same time supporting the stator 4210, may be, for example, shrink-fitted and fixed to a lower end of the stator 4210.

The other basic configuration and working effects in a compressor according to this embodiment as described above may be substantially the same as the foregoing embodiment. However, according to this embodiment, the accumulator

4500 may be installed to be separated from the shell body 4100 by a predetermined distance, thereby preventing heat generated by the shell body 4100 from being transferred to refrigerant being inhaled into an accumulating chamber of the accumulator 4500, and through this, a specific volume of the refrigerant being inhaled into a compression space of the compression device 4400 may be prevented from being increased, thereby enhancing compressor performance.

Embodiments disclosed herein provide a compressor in which an accumulating chamber of the accumulator may be formed using an internal space of the shell, thereby reducing a size of the compressor including the accumulator, and a size of an electrical product employing the compressor. Further, embodiments disclosed herein further provide a compressor in which an assembly process of the accumulator and an assembly process of the shell may be unified to simplify an assembly process of the compressor, as well as reduce a number of connecting portions during assembly of the accumulator to prevent leakage of refrigerant from occurring.

Additionally, embodiments disclosed herein provide a compressor in which an area required to install the compressor may be minimized when installing the compressor including an accumulator, thereby enhancing design flexibility of the outdoor device. Further, embodiments disclosed herein provide a compressor in which a center of gravity of the accumulator may be positioned at a location corresponding to that of the entire compressor including the accumulator, thereby reducing vibration noise of the compressor due to the accumulator.

Furthermore, embodiments disclosed herein provide a compressor in which an eccentric portion may be formed at the shaft thereof, while reducing vibration of the compressor and increasing an eccentric amount of the eccentric portion, thereby increasing compressor capacity. Also, embodiments disclosed herein provide a compressor capable of preventing leakage of refrigerant between a rolling piston and vane from occurring.

Further, embodiments disclosed herein provide a compressor in which refrigerant being discharged from the compression device may be broadly dispersed in the internal space of the shell, thereby allowing the refrigerant being discharged from the compression device to effectively cool the drive motor.

Also, embodiments disclosed herein provide a compressor in which oil may be separated from refrigerant being discharged from the compression device to prevent oil from being excessively leaked out, thereby enhancing compressor performance. Additionally, embodiments disclosed herein provide a compressor in which interference with other components due to the compressor may be minimized when installing the compressor including an accumulator in an outdoor device, thereby allowing the compressor having a weight relatively higher than that of other components to be installed at a center of gravity of the outdoor device.

Embodiments disclosed herein provide a compressor that may include a shell having a sealed internal space; a stator fixed and installed at an internal space of the shell; a rotor rotatably provided with respect to the stator to be rotated therewith; a cylinder coupled with the rotor to be rotated therewith; a plurality of bearing plates that covers both a top and a bottom of the cylinder to form a compression space together with the cylinder and coupled with the cylinder to be rotated together therewith; a stationary shaft fixed to an internal space of the shell, a shaft a center of which is formed to correspond to a rotational center of the cylinder, and an eccentric portion of which is formed to vary a volume of the compression space during rotation of the cylinder while supporting the bearing plate(s) in an axial direction; a refrigerant suction passage formed to guide refrigerant into the compression space; a rolling vane coupled with the cylinder configured to be slid with respect to the eccentric portion while being rotated together with the cylinder to compress refrigerant while dividing the compression space into a suction chamber and a discharge chamber; and an accumulator having a predetermined accumulating chamber separated from the internal space of the shell, a suction pipe communicating with the accumulating chamber, wherein an end of the stationary shaft is inserted and coupled with the accumulator such that a refrigerant suction passage of the stationary shaft communicates with the accumulating chamber.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compressor, comprising:

a shell having a sealed internal space;

a stator installed in an internal space of the shell;

a rotor rotatably provided with respect to the stator;

a cylinder coupled with the rotor to be rotated with the rotor, the cylinder having a rotational center, a top, and a bottom;

a plurality of bearings that cover the top and the bottom of the cylinder to form a compression space together with the cylinder and coupled with the cylinder to be rotated together with the cylinder;

a stationary shaft fixed in the internal space of the shell, a shaft center of the stationary shaft being coaxial to the rotational center of the cylinder, and an eccentric portion of the stationary shaft varying a volume of the compression space during rotation of the cylinder while supporting the plurality of bearings in an axial direction of the plurality of bearings;

a refrigerant suction passage that guides refrigerant into the compression space;

a rolling vane coupled with the cylinder and configured to slide with respect to the eccentric portion while being rotated together with the cylinder to compress a refrigerant, wherein the rolling vane divides the compression space into a suction chamber and a discharge chamber;

an accumulator having an accumulator chamber formed by an accumulator frame coupled with the shell, the accumulator frame being sealed with respect to the shell to air-tightly separate the accumulator chamber from the internal space of the shell; and a suction pipe that communicates with the accumulator chamber, wherein an end of the refrigerant suction passage of the stationary shaft is inserted into and coupled with the accumulator, such that the refrigerant suction passage of the stationary shaft communicates with the accumulator chamber, wherein an inlet end of the stationary shaft is positioned higher than a bottom surface of the accumulator chamber, and wherein a shaft center of the suction pipe is disposed so as not to be aligned with an axial center of the stationary shaft.

2. The compressor of claim 1, wherein the rolling vane comprises a roller portion slidably inserted onto an outer circumferential surface of the eccentric portion, a suction port that communicate the refrigerant suction passage with the compression space, and a vane portion coupled with a side of the suction port of the roller portion to be slidably inserted into the cylinder.

3. The compressor of claim 2, wherein the roller portion is formed in a ring shape.

4. The compressor of claim 2, wherein the roller portion and vane portion are molded in an integrated manner.

5. The compressor of claim 2, further comprising:

a revolving protrusion formed at an end of the vane portion; and a revolving groove formed at the roller portion to allow the revolving protrusion of the vane to be rotatably inserted and coupled therewith in a circumferential direction.

6. The compressor of claim 1, further comprising:

a discharge port that communicates with the discharge chamber formed in least one of the plurality of bearings, wherein the discharge port is formed in an opposite side to the suction port with respect to the vane portion of the rolling vane.

7. The compressor of claim 1, wherein an upper end of the stationary shaft is formed higher than a lower end of the suction pipe.

8. The compressor of claim 1, further comprising:

a discharge port and a discharge valve that discharges refrigerant compressed in the compression space into the internal space of the shell provided at a bearing of the plurality of bearings located at a lower side of the plurality of bearings.

9. The compressor of claim 8, further comprising:

a muffler installed adjacent the bearing formed with the discharge port to accommodate the discharge port and discharge valve, wherein the muffler comprises a noise space and an exhaust through hole that communicates the noise space with the internal space of the shell.

10. The compressor of claim 9, wherein the muffler is disposed adjacent an upper bearing of the plurality of bearings.

11. The compressor of claim 9, wherein the muffler is disposed adjacent a lower bearing of the plurality of bearings.

12. The compressor of claim 9, wherein the exhaust through hole is formed in a plane portion of the muffler facing a bottom surface of the shell.

13. The compressor of claim 9, wherein the exhaust through hole further comprises a guide surface portion that guides refrigerant in a direction of an inner surface of the shell.

14. The compressor of claim 9, wherein the exhaust through hole is formed in a lateral surface portion of the muffler facing an inner side surface of the shell.

15. The compressor of claim 14, wherein an outlet port of the exhaust through hole faces a coil of the stator.

16. The compressor of claim 9, wherein the discharge port is inclined in a forward direction with respect to a rotational direction of the cylinder.

17. The compressor of claim 1, wherein the accumulator frame is coupled with the shell to form the accumulator chamber together with an inner circumferential surface of the shell.

18. The compressor of claim 1, wherein the accumulator frame is coupled with the shell to form the accumulator chamber together with an outer circumferential surface of the shell.

19. The compressor of claim 1, wherein the accumulator frame is separated from an inner circumferential surface of the shell to form the accumulator chamber of the accumulator.

* * * * *